US012735824B2

(12) United States Patent
Plata Amarillas et al.

(10) Patent No.: US 12,735,824 B2
(45) Date of Patent: Sep. 15, 2026

(54) ADAPTATIVE WASHING SYSTEM FOR DIFFERENT WATER AND/OR LOAD LEVELS

(71) Applicant: CONTROLADORA MABE, S.A. DE C.V., Mexico City (MX)

(72) Inventors: Santiago Alonso Plata Amarillas, Querétaro (MX); Raúl López Guerrero, Querétaro (MX); José Alfredo Ramirez Olvera, Querétaro (MX); Carlos Humberto Reyes Andrés, Querétaro (MX)

(73) Assignee: CONTROLADORA MABE, S.A. DE C.V., Mexico City (MX)

( * ) Notice: Subject to any disclaimer, the term of this patent is extended or adjusted under 35 U.S.C. 154(b) by 351 days.

(21) Appl. No.: 18/209,682

(22) Filed: Jun. 14, 2023

(65) Prior Publication Data

US 2024/0328054 A1 Oct. 3, 2024

(51) Int. Cl.

| | |
|---|---|
| ***D06F 33/36*** | (2020.01) |
| ***D06F 34/28*** | (2020.01) |
| ***D06F 35/00*** | (2006.01) |
| *D06F 101/20* | (2020.01) |
| *D06F 103/02* | (2020.01) |

(Continued)

(52) U.S. Cl.

CPC ..... *D06F 33/36* (2020.02); *D06F 34/28* (2020.02); *D06F 35/006* (2013.01); *D06F 2101/20* (2020.02); *D06F 2103/02* (2020.02); *D06F 2103/18* (2020.02); *D06F 2105/52* (2020.02)

(58) Field of Classification Search

None

See application file for complete search history.

(56) References Cited

U.S. PATENT DOCUMENTS

| | | | | |
|---|---|---|---|---|
| 4,986,093 | A | 1/1991 | Pastryk et al. | |
| 2011/0099726 | A1* | 5/2011 | Plata Amarillas ..... | D06F 33/32 68/12.01 |

(Continued)

FOREIGN PATENT DOCUMENTS

| | | |
|---|---|---|
| EP | 0668389 | 4/1999 |

*Primary Examiner* — Cristi J Tate-Sims

(74) *Attorney, Agent, or Firm* — Terry M. Sanks, Esq.; Beusse Sanks, PLLC

(57) ABSTRACT

The present invention relates to the field of washing machines, in particular a domestic washing machine, keeping in mind that the objects to be washed are of different nature, manufacture, materials, geometry and volume, in addition to having different types and levels of dirt. Therefore, different types of washing patterns have been developed in order to wash them effectively, ensuring as little damage and wear as possible; the agitation sequence proposed by the washing method of the present invention is carried out progressively, both incrementally and decrementally, using progressive agitation blocks that comprise a sequence of agitation patterns, wherein according to the user's preferences, laundry load and water level inside the washing machine, the number of agitation blocks is determined, the type of agitation sequences to be used for each agitation block, a first initial agitation pattern, the changes in the variables of arc or paddle stroke length, spm, and agitation period, of the subsequent agitation patterns as well as the number of patterns to be used per progressive agitation block.

12 Claims, 11 Drawing Sheets

(51) Int. Cl.
*D06F 103/18* (2020.01)
*D06F 105/52* (2020.01)

(56) References Cited

U.S. PATENT DOCUMENTS

2012/0180534 A1* 7/2012 Cho ..... D06F 35/006
68/18 R
2015/0121630 A1* 5/2015 Lee ..... D06F 33/32
68/12.04

* cited by examiner

ADAPTATIVE WASHING SYSTEM FOR DIFFERENT WATER AND/OR LOAD LEVELS

FIELD OF THE INVENTION

This invention refers to a washing method, specifically a washing method in automatic washing machines with a basket that rotates concentrically inside a tub, said basket is driven by a motor equipped with a rotor position sensor, wherein the washing method carries out the sequences of: arranging the laundry, detecting (sensing) the load, filling of the tub to washing level, progressive agitation either incrementally or decrementally, arrangement and balancing agitation, dehydration, rinse.

BRIEF DESCRIPTION OF THE PRIOR ART

This invention lies in the field of automatic domestic washing machines, which have recently generated growing concerns about their water consumption, energy consumption and washing efficiency. This has led to the design of various alternatives that allow a rational use of this vital liquid, as well as a rational use of energy, in addition to various washing methods that promote efficient dirt removal.

On the other hand, some types of washing machines, such as front-loading washing machines, which use little water, have in many cases compromised their stain removal performance, and the washing cycle becomes longer or they have to use means for raising the temperature of the water (a process that in turn consumes high amounts of energy) in order to improve the chemical power of the detergents or other additives that are added to the water to form the wash liquor. These front-loading or horizontal axis washing machines face the problem described above; although their water consumption is reduced compared to a top-loading or vertical axis washing machine, they have very long cycles and need to heat the water, thus increasing their power consumption. By not having an agitator or propeller, they do not generate large currents of water that go through the fabrics of the objects to be washed and since they do not have scrubbers, the "scrubbing" effect is not carried out, so their surfaces are not strongly rubbed against the surface of the objects to be washed. Likewise, the aforementioned front-loading or horizontal axis washing machines also require sleepers attached to the length of the cylinder or basket that help turn and stir the laundry, creating friction between them, as well as against the referred sleepers and the inner surface of the basket. These significant differences, on the one hand, mean that the washing cycles of a front-loading or vertical axis washing machine are long washing cycles, evidently due to the low friction created between the objects to be washed, these are less mistreated, which makes it more difficult to remove stains or dirt adhered to the fibers of the fabrics, namely that there are low currents of water or wash liquor that go through said fabrics, coupled with low friction between the laundry items themselves, thus resorting to the chemical action of the wash liquor, which in order to enhance said detergent action requires heating the wash liquor in addition to lengthening the washing cycle in order to obtain a good washing action on the textiles or objects to be washed.

On the other hand, top-loading or vertical axis washers require large amounts of water for the propeller or agitator to create large currents of water that, together with the action of the propeller or agitator scrubbers, rub on the surface or fabrics of the objects to be washed, in addition to the chemical action of the detergents that helps to remove stains strongly adhered to the fibers of the textiles. This system achieves shorter washing cycles that use less energy, but at the cost of greater water consumption, also in some cases creating unnecessary friction or scrubbing during agitation, excessively wearing down the objects to be washed, or otherwise having a very gentle agitation that does not remove the dirt.

Therefore, there is a need for a new washing technology which must: have low water consumption in combination with low energy consumption, create strong water currents that pass the wash liquor between the fibers of the fabrics, vigorously scrub the items to be washed without damaging them, mix the water with the chemicals before the latter come into contact with the objects to be washed, which helps, among other things, to start the chemical action quickly by homogenizing the mixture, making better use of its chemical action to achieve good washing efficiency together with an agitation sequence that allows varying the intensity of agitation, helping to avoid unnecessary wear on the garments to be washed. These and other reasons lead us to think of a vertical load washing machine, which must have a very particular agitator or propeller that allows washing with a small volume of water. Thus, it should also have a washing method that helps conserve energy, as well as efficient washing, these being, among others, the object of the present invention.

Various efforts have been made with a view to reducing water and energy consumption in domestic washing machines, such as in the case of document U.S. Pat. No. 4,986,093 by Pastryk et al., which describes a recirculation system provided with a tank that mechanically adheres to the washing machine tub. Said tank receives the detergent or chemicals and a certain volume of water, the tank is used to mix the detergent with the chemicals so that they can be poured as a shower on the objects to be washed. This solution has the drawback of using large volumes of water for the washing cycle, namely that it is carried out in the traditional way, that is: the tub is filled up to a certain level of water, immersing the objects to be washed completely in said liquid, immediately after which the agitation cycle begins, with the variant that before said agitation, the mixture or wash liquor contained in the tank is pumped towards a nose or shower that sprays the objects to be washed with said wash liquor. We can deduce that this method and arrangement of the tank do not contribute greatly to substantial water or energy savings; although it is a starting point for future developments, namely that mixing water with detergents or chemicals before they come into contact with the objects to be washed prevents an unwanted chemical attack on the textiles and improves the mixing proportions for a more uniform wash liquor, coupled with the fact that this increases the performance of detergents or washing chemicals.

A second example is document EP 0 668 389 by Kretchman et al., which represents an improvement with respect to the previously cited document. Specifically, the space between the bottom of the basket and the bottom of the tub has been used to store water, to which are added detergent or washing chemicals once a certain level of liquid has been reached in the area in question, which are mixed to form a wash liquor, by means of a pump placed in a well and hoses, the wash liquor is extracted to be sprayed over the upper part of the basket, while the bottom of the basket rotates with one or two degrees of freedom. Thus, once again, we can deduce that, although the small improvement of storing water in the bottom of the tub is of great help, the circular and undulating movement of the bottom of the basket, rather than helping, would seem more like an artifice found in a fairground attraction. However, this does not represent an improvement in the performance of removing stains or dirt from the objects to be washed.

Thus, in view of the problems described above, coupled with a greater demand by household appliance consumers of more efficient appliances, with better features, low cost, reliability, and in particular with reduced water consumption, we have developed the present invention.

BRIEF DESCRIPTION OF THE INVENTION

The hybrid washing method of the present invention has the peculiarity of adapting to the different washing conditions imposed by the different washing habits of the users. Thus, the washing sequences are not fixed, but rather tend to vary in the period in which they are executed, with vigorous agitation at the beginning of the sequence to end with gentle agitation or vice versa, agitating the objects according to the level of dirt of the laundry that varies as the agitation sequence progresses.

The washing method of the preferred embodiment of the invention begins when the user has introduced a certain amount of items to be washed, optionally a certain amount of washing additives, has selected the program to be used and has instructed the washing machine to start. This initiates a laundry arrangement sequence, then checks the water level, to then fill with water to a minimum level, carries out a load detection or sensing sequence wherein it determines the amount of objects to be washed inside the basket, with the aim of being able to determine the suitable amount or level of water, so once the size of the load is determined, water is introduced up to the predetermined level according to the amount of load determined (minimum, medium, high, maximum, Aux1, Aux2), after which the progressive agitation sequence begins for a certain period and then the arrangement and balancing agitation sequence for another certain period; subsequently, dehydration is carried out to subsequently rinse the objects to be washed deposited inside the basket, ending with the final dehydration. Yes, as can be deduced, this innovative washing method is efficient in both energy use and water consumption, and reduces unnecessary friction on the objects to be washed, preventing mistreatment, and ensuring efficient scrubbing.

DETAILED DESCRIPTION OF THE INVENTION

Definitions

Figure 1:
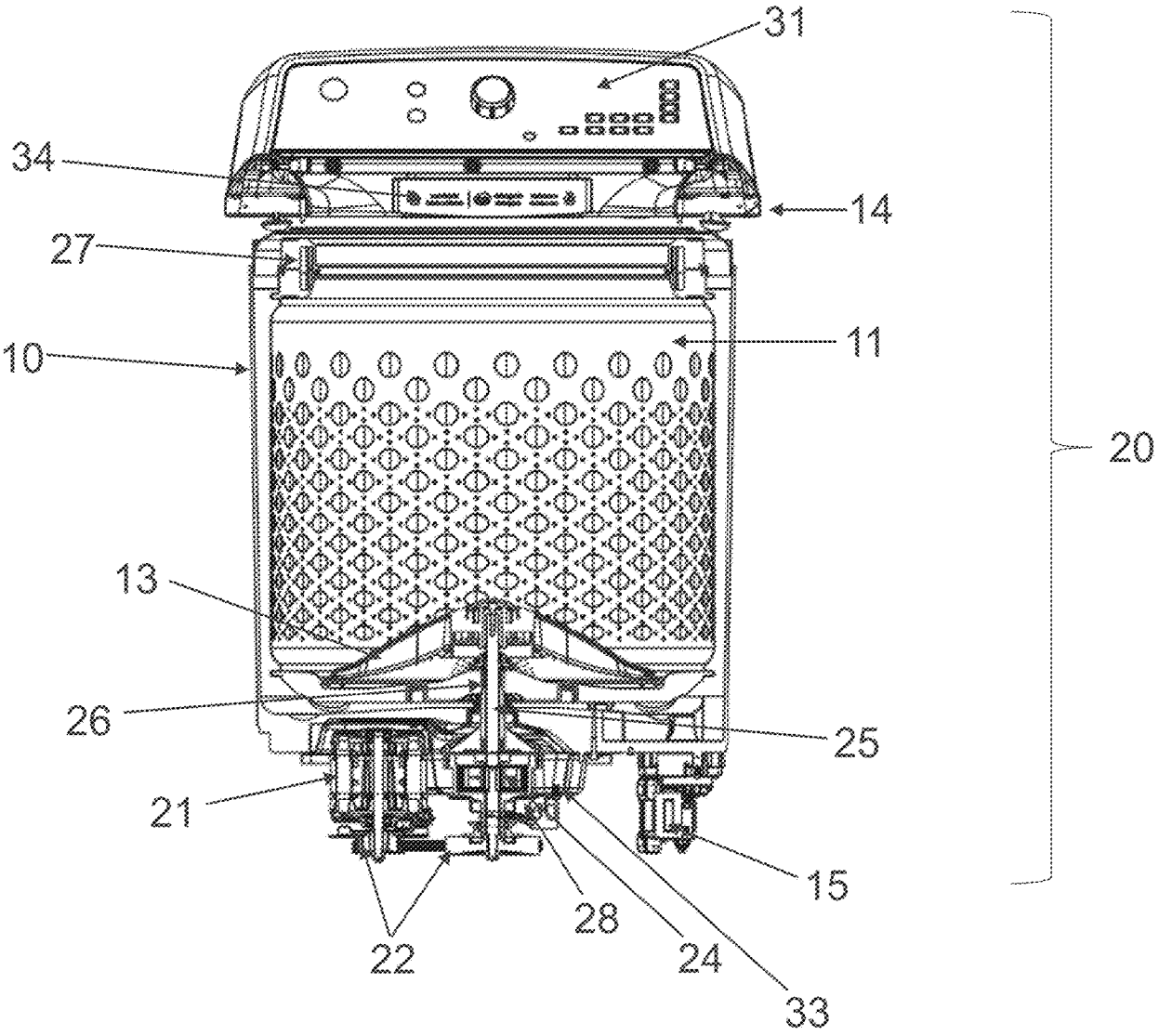
FIG. 1 is a cross section of a washing machine.

The following definitions are provided for the purpose of allowing a better understanding of the invention:

Arc. Angular distance that the agitator or propeller 13 moves, measured in degrees from its state of rest until it returns to the rest position.

Target Arc. The expected angular distance that the agitator or propeller 13 must travel while the motor 21 is energized.

Arc measurement. Carried out in the preferred embodiment of the present invention preferably by means of a Hall rotor position sensor 44 installed in the motor 24, which reports a certain number of pulses to the electronic control 40 each time the motor 24 is actuated in each direction, said number of pulses is directly proportional to the arc length, so a certain number of pulses can be related to a given arc length. Thus the electronic control 40 compares the pulses measured by the rotor position sensor 44 per stroke or paddle stroke against a certain target range of pulses.

Paddle stroke. The clockwise (CW) or counterclockwise (CCW) circular displacement (or angular path) of the agitator or propeller 13 over a certain period of time; this is achieved when the clutch 28 is in agitating mode, the electronic control 40 starts the timing with an internal timer and at the same time sends a signal to the motor 21 driver 72 to energize the motor 21, thus driving the agitator or propeller 13 which will describe a certain arc that is measured thanks to the rotor position sensor 44, namely that the latter sends a string of pulses to the electronic control 40, which counts them, since said electronic control 40 has a directly proportional reference between the number of pulses counted and the arc described by the agitator or propeller 13; thus, when the electronic control 40 detects that the target arc has been reached, the signal to the motor 21 driver 72 is interrupted and stops the counting of the internal timer, namely that the agitator or propeller 13 to carry out its displacement and comply with the trajectory of the target arc has a specified period of time, if this time elapses before the agitator or propeller 13 reaches its angular displacement, the electronic control 40 will begin counting for a certain waiting time that ranges from 0.01 second to 5 seconds, once the angular displacement condition or the time elapsed condition has been fulfilled; said waiting time must elapse before starting a new paddle stroke in the opposite direction to the immediately preceding one.

Strokes per minute. SPM by its initials, refers to the number of continuous paddle strokes in both directions that the agitator or propeller 13 makes (i.e. clockwise (CW) and counterclockwise (CCW)) in one minute, including the waiting time between paddle strokes.

Agitation. Movement imparted to the objects to be washed by the action of the agitator or propeller 13 on the aforementioned objects to be washed immersed in wash liquor arranged in the basket 10 of the washing machine 20.

Target arc of agitation. Angular displacement of a certain point of the agitator or propeller 13 which has an arc length that oscillates between 180 and 2160 degrees with a frequency between 30 and 100 strokes per minute (spm).

Jam. According to the arc measurement, if the arc of a paddle stroke is found to be significantly less than the target agitation arc, the electronic control 40 assumes that the agitator or propeller 13 has become stuck or jammed due to the resistance that the load or the objects to be washed imposes on it, or that a high concentration of objects to be washed has accumulated in a reduced volume inside the basket, causing an undesired high density of objects to be washed in some area inside the basket 12.

Figure 4:
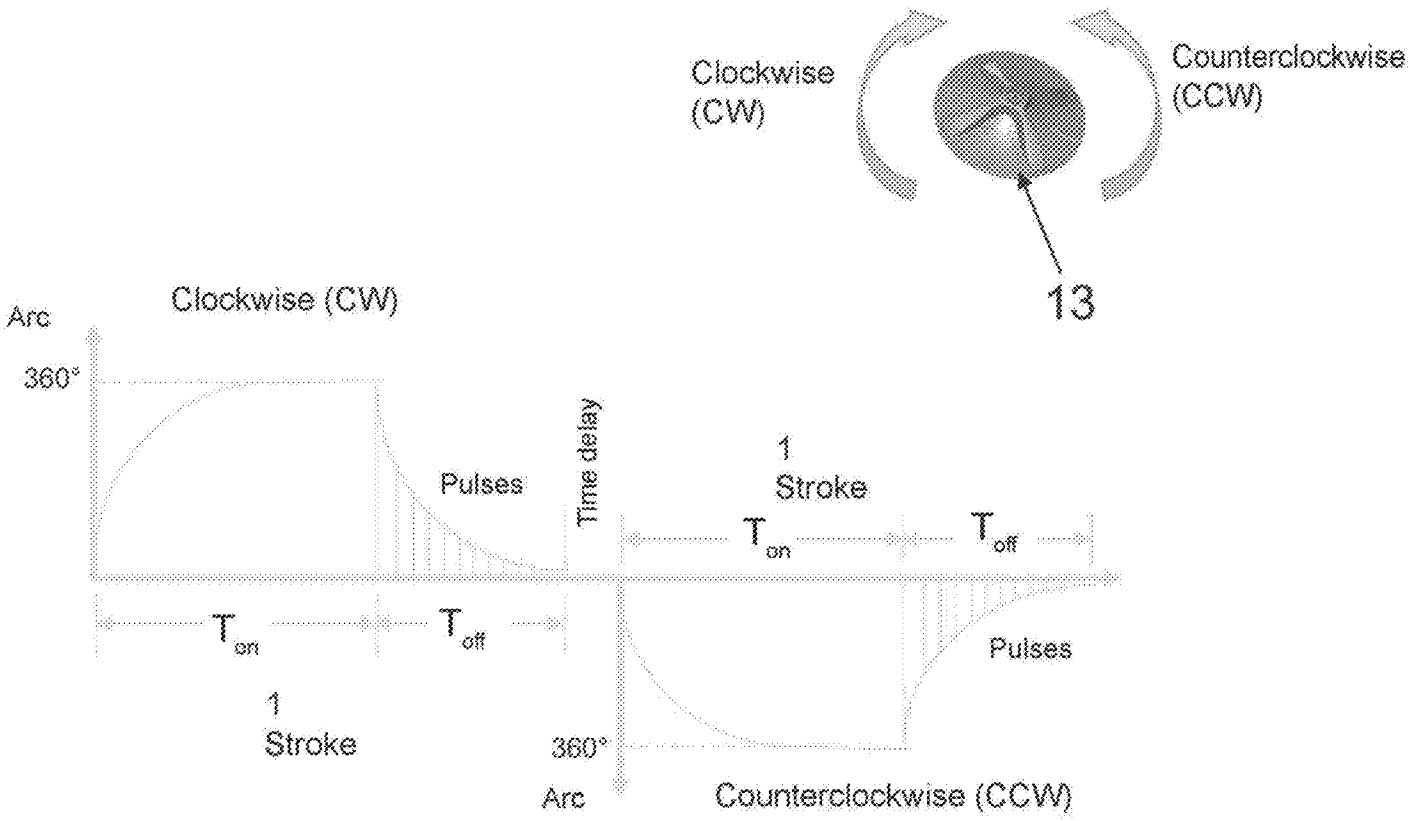
FIG. 4 is a diagram of arc length versus time that allows visualizing how an arc or paddle stroke is built.

Agitation pattern. This refers to the CW and CCW paddle stroke pattern used to achieve an agitation mode; the agitation pattern is made up of a paddle stroke with a target arc and a certain SPM (see FIG. 4), which in a preferred embodiment is carried out for a certain time, or in an alternative mode is carried out for a certain number of paddle strokes.

Mechanical fixing, mechanical fastening, mechanical joining or mechanical anchoring.—This refers to the joining of two or more parts by means of bolts and nuts; rivets; arc, wire or friction welding; or binders, among other mechanical means known in the field.

Mechanically coupled, mechanical coupling or mechanical joint.—This refers to the transmission of mechanical energy from one element to another by means of gears, friction pulleys, belt pulleys, magnetic means, mechanical transmissions, among others.

"Approximately"—The use of the term "approximately" provides a certain additional range with respect to the numerical value to which it is applied. Such additional range is approximately ±10%. In an exemplary but non-limiting manner, where "approximately 40 grams" is stated, the exact range that is described and/or claimed comprises between 36 grams and 44 grams.

FIGS. 1 to 11 are used interchangeably in the present description.

Figure 2:
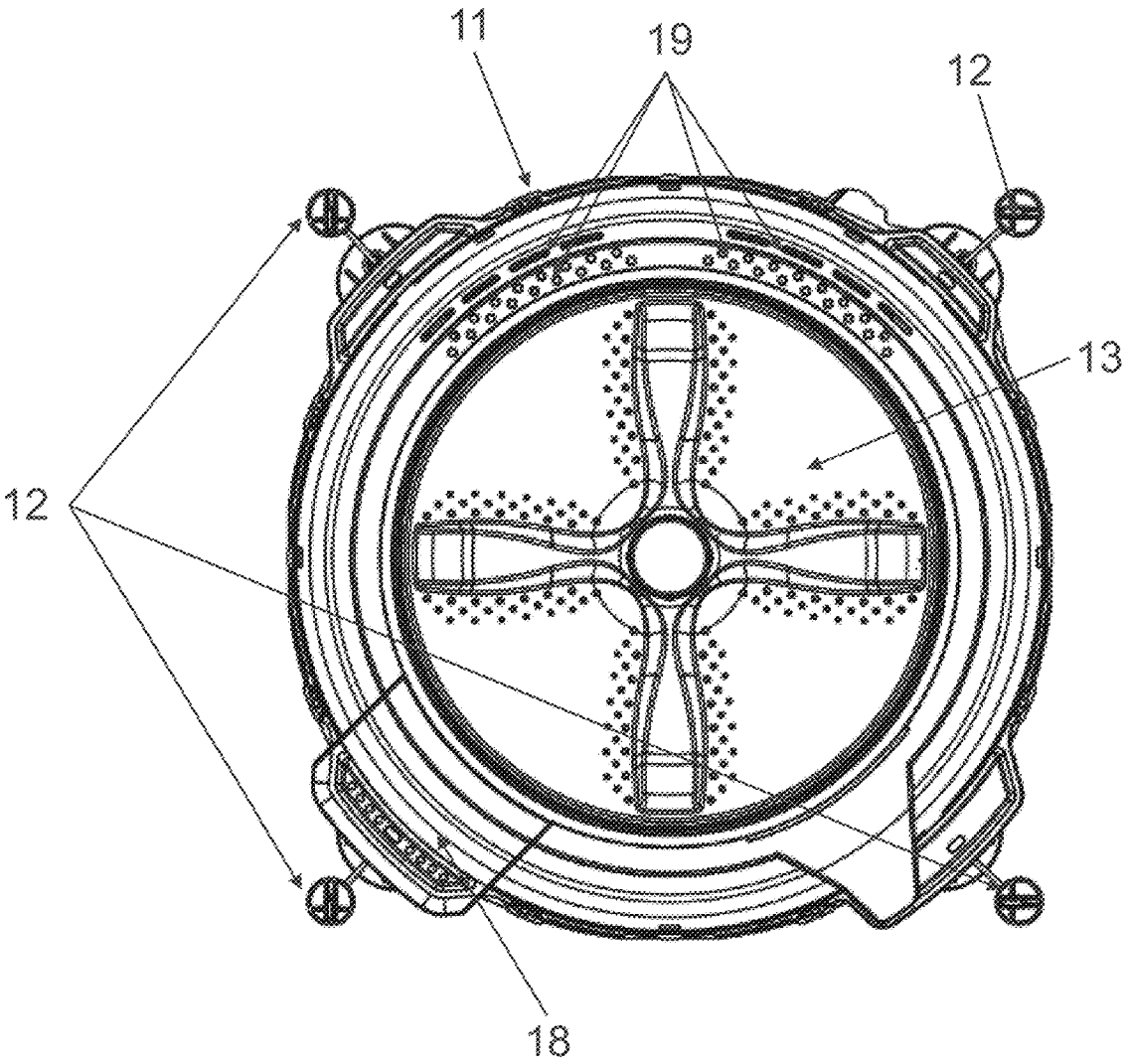
FIG. 2 is a top view of a sub-washer, that is, a washer without a cabinet.
Figure 3:
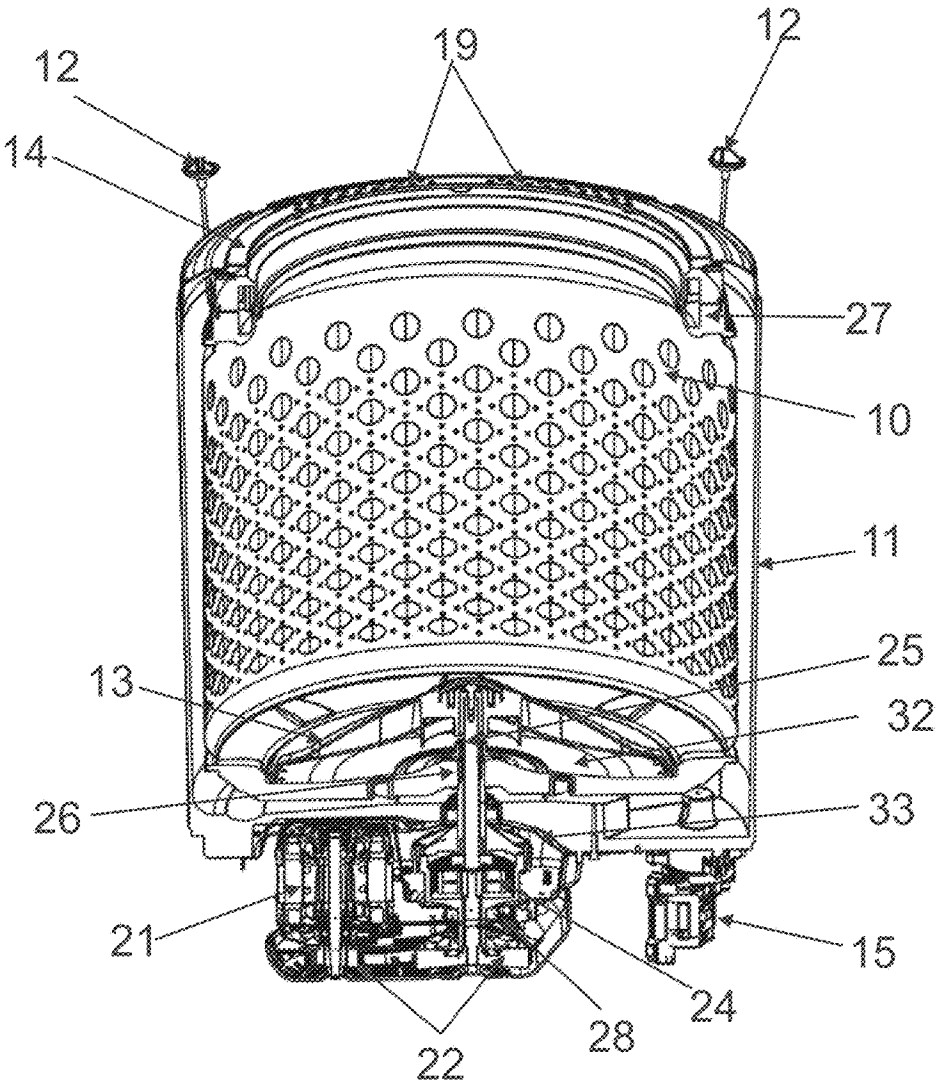
FIG. 3 is an isometric cross section of a sub-washer.

The washing machine object of the present invention, illustrated in FIGS. 1, 2 and 3, is of the top-loading or vertical axis type, for which it has a cabinet to which four suspension bars 12 are attached. Said suspension bars 12 support the weight of the tub 11 together with the rest of accessories of the aforementioned cabinet, in addition to acting as a damper of the vibration that occurs during the washing process. Thus, the tub 11 is hung from the aforementioned suspension bars 12 by means of lugs arranged in the lower part of the aforementioned tub 11. The rest of the peripheral equipment is mounted on said tub 11, such as the motor 21, optionally a planetary reduction box 24, which in an alternative embodiment of the present invention can be omitted, adjusting the relationship of the pulleys 22, that is, the pulley 22 with the largest diameter will fit on the internal shaft 25, which will receive power from the electric motor 21 thanks to the arrangement of the pulleys 22 and belt. Optionally, the shaft 25 at its upper end is coupled to a planetary box 24, with the aim of reducing the angular speed and thus obtaining greater torque, the output shaft of the planetary box 24 is reintegrated into a shaft 25, at the upper end of which sits the agitator or propeller 13. Optionally, the internal shaft 25 has the pulley 22 of greater diameter coupled at its lower end and the agitator or propeller 13 coupled at its upper end. The hollow shaft 26 houses inside it the internal shaft 25. Said hollow shaft 26 is mechanically coupled to a clutch 28 that can make both shafts 25, 26 rotate together or independently (spin mode or agitation mode, respectively). Said hollow shaft 26 is mechanically coupled to the center of the basket or to the "hub" 32, so that when the shafts 25, 26 are engaged rotating together (spin mode), the hollow shaft 26 will transmit energy to the basket 10 so that it rotates together with the agitator 13.

The basket 10 is crowned with a balance ring 27 which counteracts the unbalance caused by placing the objects to be washed in the basket 10. The tub 11, for its part, has a tub cover 14 assembled at its upper end, which houses a grill 19 and a spray deflector 18. For its part, the cabinet is covered by the main cover 30 that covers the upper part of the washing machine 20. Said main cover 30 serves as a support for a top 31 that houses the electronic components such as the control 40, the drivers 71 to 79, the pressure sensor or pressure switch 41, among others, as well as the door or lid of the washing machine 29 through which the objects to be washed are introduced.

Figure 11:
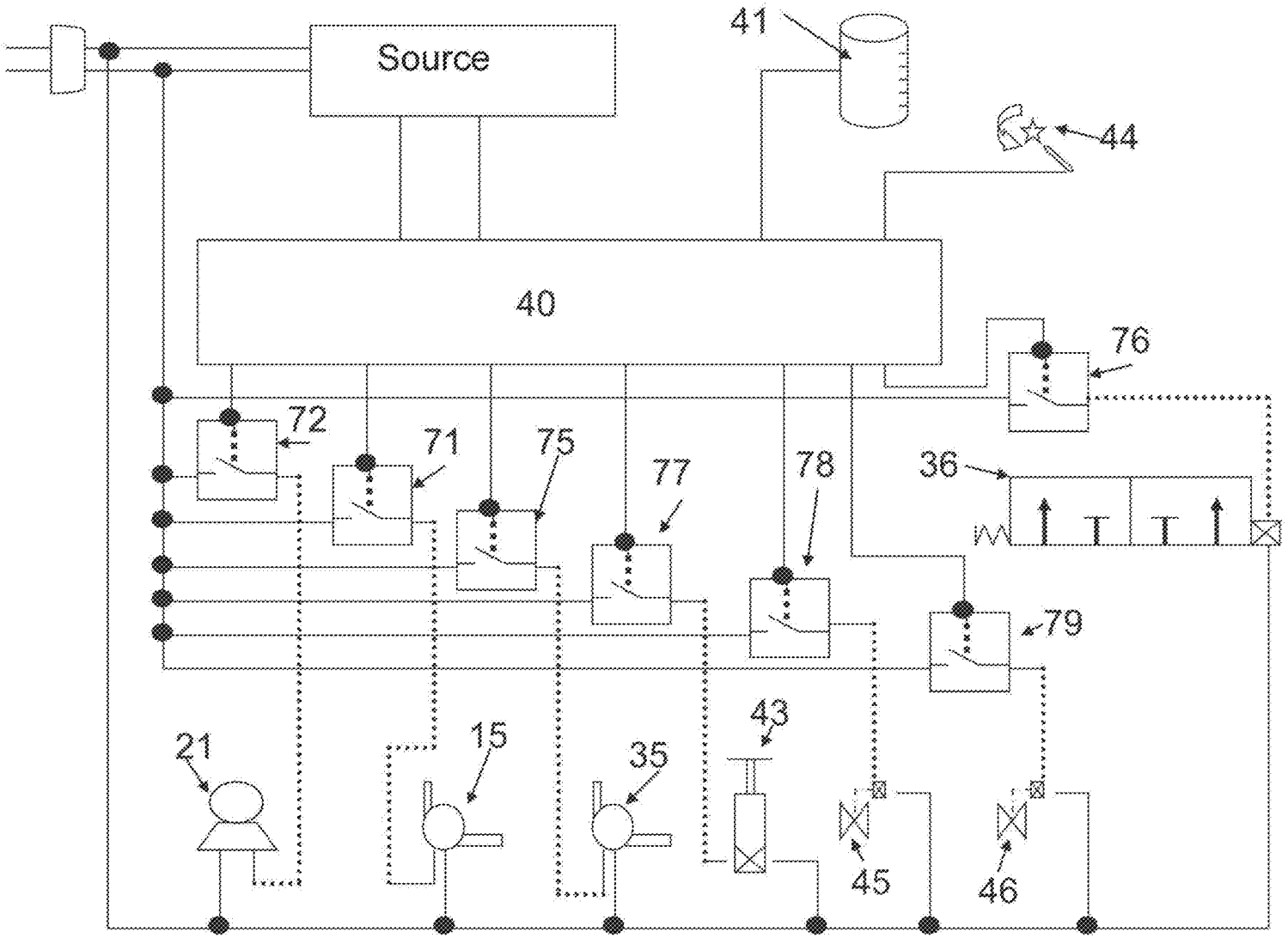
FIG. 11 is an electrical diagram of the components required by the high efficiency washing method of the present invention.

FIG. 11 details the connection of the electronic control 40 with the various sensors or actuators that it controls, which allows the correct operation of the washing machine 20 by sending signals to the different actuators at the times determined by the method that is the subject matter of the present invention. Thus, the electric motor 24 is energized by means of a driver 72 that receives signals from the electronic control 40. The aforementioned electronic control 40 sends a pulse of a certain length to the driver 72 so that, during the time said pulse length lasts, it energizes the motor 24 in one direction. The same happens to energize the motor 24 in the opposite direction, with a certain waiting time between paddle strokes or pulse widths.

Figure 6:
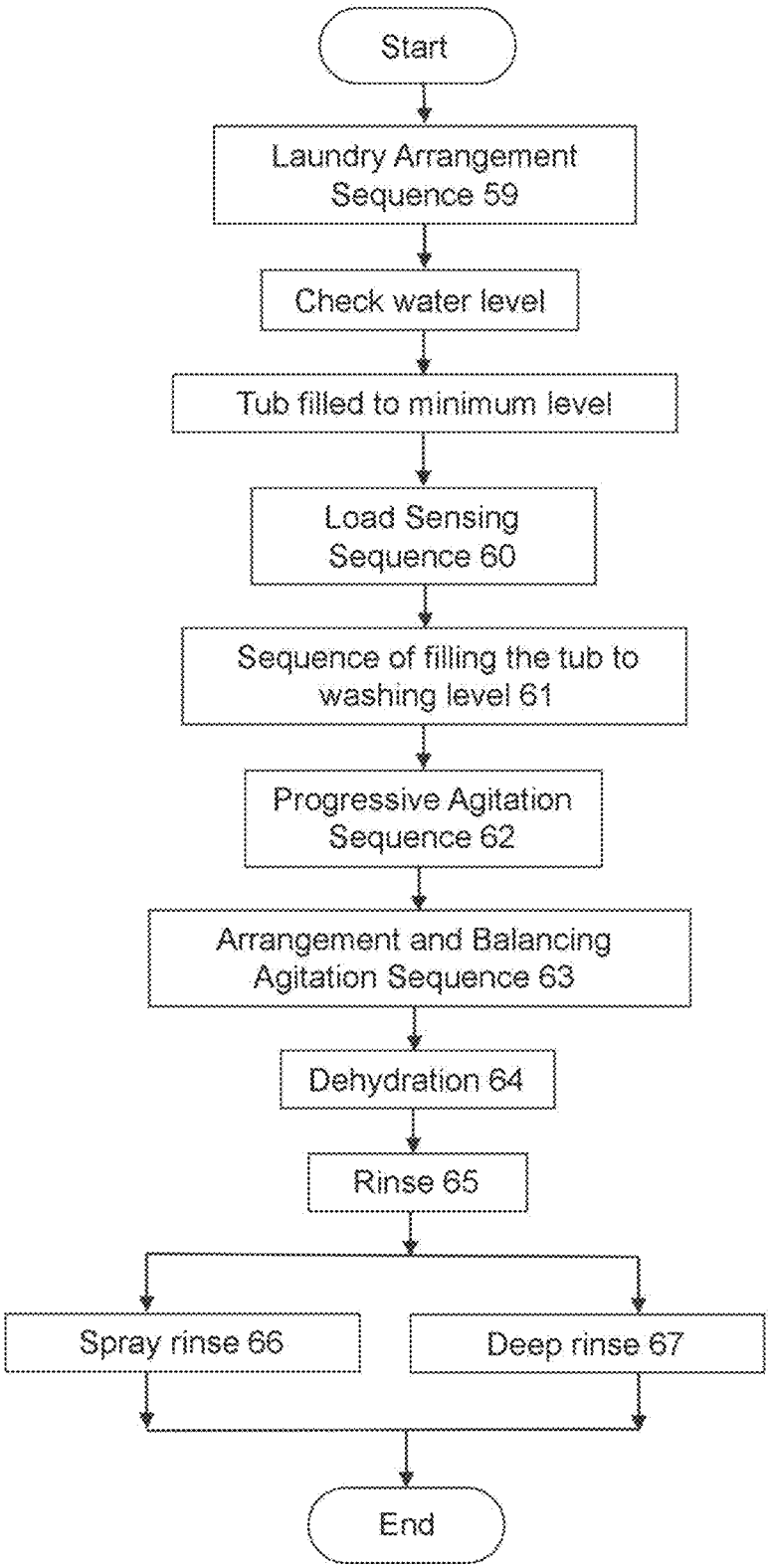
FIG. 6 is a block diagram of the high efficiency washing method of the present invention.

The washing method illustrated in FIG. 6 comprises a series of sequences that in a preferred embodiment follow the order proposed in the aforementioned FIG. 6; however, as a person skilled in the art can observe, the order of the sequences can be altered and some sequences even repeated, or sequences inserted between others, which should not depart from the spirit of the present invention; therefore, each of the sequences represented in FIG. 6 will first be presented independently; and finally a preferred embodiment of the washing method that is the subject matter of the present invention will be presented.

Laundry Arrangement Sequence 59

This laundry arrangement sequence 59 serves to evenly distribute the objects to be washed inside the basket 10, avoiding concentrations of objects to be washed in a small space, which causes high densities of objects to be washed or clumping of the objects to be washed inside the basket 10, not allowing efficient contact with the agitator or propeller 13, which leads to an undesirable movement of the objects to be washed inside the basket 10 by not being able to follow the flow of wash liquor generated by the agitator or propeller 13; consequently, the currents of wash liquor that pass through the fibers of the objects to be washed do not have sufficient strength, thus reducing their washing capacity. It is for these reasons, together with others, that it is necessary to carry out an efficient laundry arrangement inside the basket 10 prior to the agitation sequence, with the aim of achieving good washability of the objects to be washed.

The electronic control 40 checks that the basket 10 is in its rest state by reading the signal from the rotor position sensor 44 while the basket 10 recovers its rest state, having detected this condition when the electronic control 40 confirms the absence of pulses from the rotor position sensor 44, once the basket 10 is checked to be in a state of rest, the electronic control 40 sends a pulse of between 8 to 12 seconds to the driver 78 of the filling or water intake valve 45 to allow the flow of fresh water into the tub 11, which, in an alternative embodiment of the invention, can be hydraulically connected to the chemical dispenser 34, thus the electronic control 40 also sending a pulse for the same period of time to the driver 74 of the aforementioned chemical dispenser 34; in yet another alternative embodiment of the invention, the electronic control 40 sends a pulse for a certain period of time to the driver 79 of the liquid bleach intake valve 46, so that it allows the admission of this liquid in the event that the user has deposited a certain volume of liquid bleach in the corresponding compartment of the chemical dispenser 34. Thus, when the liquid bleach intake valve 46 opens, a flow of water is admitted that is led through the chemical dispenser 34, taking with it the volume of bleach deposited in said chemical dispenser 34, which directs the washing so that it falls like a waterfall through the buffer onto the grid 19, which allows the passage of the wash liquor between the tub 11 and the basket 10, avoiding contact with the objects to be washed, thus depositing the wash liquor at the bottom of the basket, which allows a uniform mixture of the chemicals with the water, without throwing the chemicals directly onto the objects to be washed, which can cause stains caused by chemical attack on the surface of the objects to be washed due to a poor dilution and mixing of the chemicals with the water.

Once the aforementioned pulse width of the driver 79 of the liquid bleach intake valve 46 has been exhausted, the electronic control sends a pulse of between 2 to 20 seconds to the driver 71 of the pump 15, which allows it to dispense wash liquor during the width of said pulse to the spray deflector 18, spraying with wash liquor the objects to be washed that are inside the cone of action of said spray deflector 18. Once the duration of the pulse to the driver 71 of the pump 15 in question has expired, these steps are repeated for a certain period of time ranging from 30 to 60 seconds, or at least one revolution of the basket 10, in such a way that the objects to be washed contained in the basket 10 are soaked with the wash liquor accumulated in the bottom of the tub 11. Immediately afterwards, once all or most of the volume of water accumulated in the bottom of the tub 11 has been transferred to the objects to be washed, the electronic control 40 sends a pulse that oscillates between 5 and 15 seconds to the driver 72 of the motor 21, remembering that the clutch 28 is in dehydration mode; this allows the basket 10 to rotate the hydrated objects to be washed contained in the basket 10—it should be noted here that the hydrated objects to be washed are heavier because they now hold between their fibers the volume of water that was introduced to the bottom of the tub 11, so by subjecting them to a centrifugal force greater than the force exerted by gravity for a certain time, the textiles will tend to settle by adhering to the circular wall of the basket 10, in addition to promoting the extraction of the wash liquor contained in said objects to be washed and therefore dehydrating them, with the wash liquor collecting at the bottom of the tub 11 to, in a preferred embodiment, proceed with its extraction by means of the drain pump 35 and drain hose 16 or, in an alternative embodiment, to store it there for its subsequent use in the laundry arrangement sequence 59 under discussion or in another alternative embodiment for use in the following sequence of the washing method. However, in any embodiment, while the basket is rotating, the rotor position sensor 44 sends a string of pulses to the electronic control 40, which in turn determines the speed at which the motor 21 is rotating thanks to its internal logic. Thus, when the motor 21 reaches a speed that oscillates between 90 to 150 rpm, the electronic control 40 de-energizes the driver 72 of the motor 21, causing the immediate deceleration of the basket 10 until the basket 10 recovers its state of rest, the electronic control 40 having detected this condition thanks to the absence of pulses from the rotor position sensor 44; in an alternative embodiment of the present invention the steps of this sequence are repeated at least once, which will help to better accommodate the textiles inside the basket 10.

Water Level Check

From reading the previous lines, it can be deduced that at the end of some sequences of the washing method being disclosed there may be remnants of water, or the water level may be low when resuming a sequence of the washing method due to a failure with the power supply or an interruption of the washing method by the user; thus, there is a specialized block or sequence within the washing method to detect the water level inside the tub.

Figure 5:
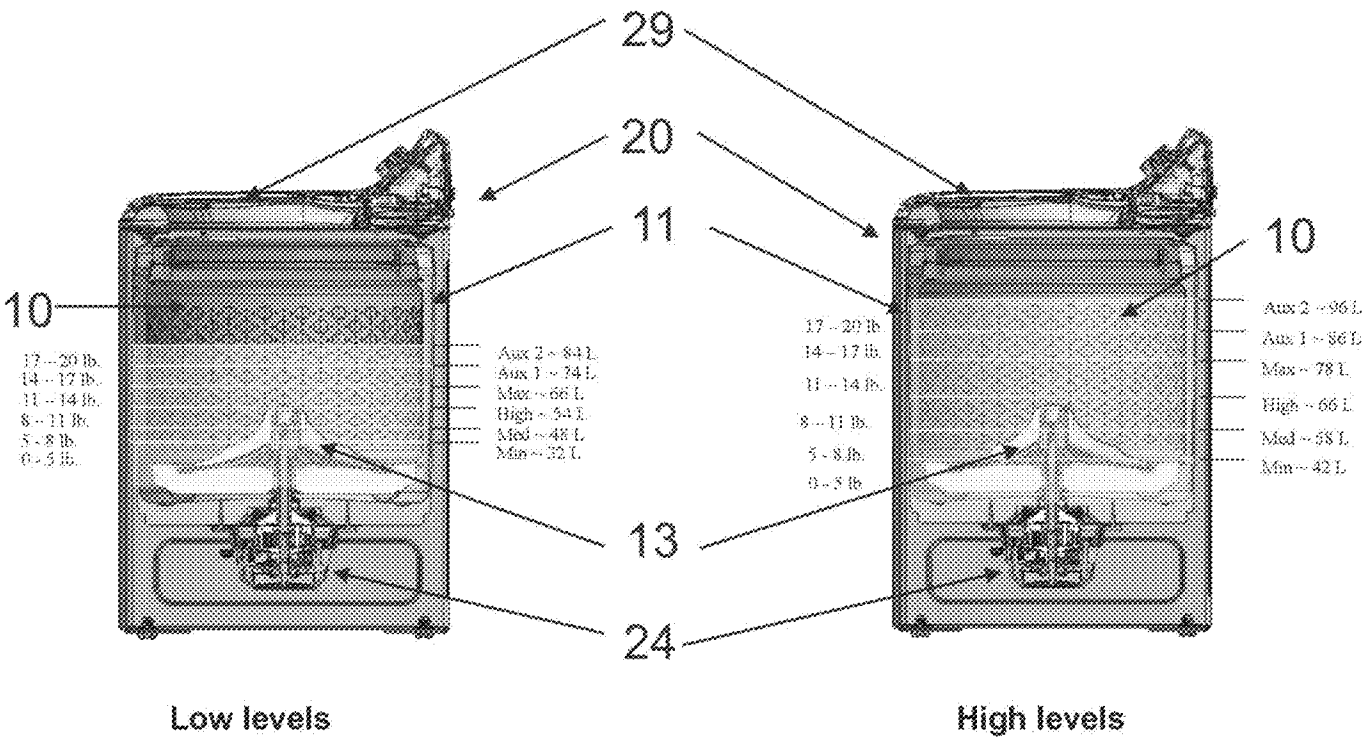
FIG. 5 are two cross-sectional views of a washing machine, in which we can see the "low" washing levels as well as the "high" washing levels.

In order to detect the water level inside the tub 11, the electronic control 40 receives signal values from the level sensor or pressure switch 41 and processes them by comparing them against the data stored in its data memory for different pressure sensor or pressure switch 41 signal values associated with a certain volume of water inside the tub 11, in such a way that the electronic control can know the amount of water inside the tub 11 by processing a signal value from the pressure sensor or pressure switch 41, thus in this water level check sequence, it requires that the electronic control 40 read the value of the signal coming from the pressure switch 41 and from this value determine the volume of water inside the tub and, if applicable, know if said volume of water is associated with a predetermined level such as those illustrated in FIG. 5 (minimum, medium, high, max, Aux1, Aux2, for "high" or "low" levels); or failing that, when water enters the tub 11 to know when said water levels have been reached so that the electronic control 40 can take the corresponding action.

Tub Filled to Minimum Level.

The electronic control 40 is arranged to introduce water up to a certain minimum level or also called load sensing level within the tub 11, for this, in a preferred embodiment the electronic control 40 has already checked the water level in the tub 11 as mentioned above; in the event that the electronic control notices that the level inside the tub 11 is less than the minimum level, the electronic control 40 then sends a signal to the driver 78 of at least one water intake valve 45 to energize at least one intake valve 45, it should be mentioned that in a preferred alternative embodiment, the electronic control 40 may send a control signal simultaneously or alternately to the corresponding drivers 78 of the corresponding hot water and cold water intake valves (valves 45), allowing the flow of water into the tub 11 until reaching the water level, at which point the level sensor or pressure switch 41 sends a signal to the electronic control 40 which, upon receiving it, will stop the control signal towards the driver 78 of the at least one filling valve 45; now, in another case, that is, that the electronic control 40 detects that there is a water level equal to or greater than the minimum level, the electronic control 40 will proceed to the next sequence of the washing method (see FIG. 6) without admitting more water into the tub 11.

Load Detection or Sensing Sequence 60

The purpose of this sequence is to determine, using a particular agitation pattern, the amount and type of objects to be washed, so that depending on the resistance that said load offers to the movement of the agitator or propeller 13, the corresponding water levels can be defined for agitation during the washing phase (in the particular case of the present invention it is the progressive agitation sequence 62), the dehydration steps 69 and the rinse 65 in any of its modalities (66, 67).

The electronic control 40 must somehow collect qualitative data on the amount of objects to be washed inside the basket 10 in order to determine the water level to be used during the progressive agitation sequence 62, the dehydration step 64 and the rinse steps 65 in any of its modalities (66, 67), the determination of the level of water to be used also impacts the profile of spin ramps to be used in the dehydration step 64 or spinning in general of the objects arranged in the basket 10.

Thus, the present sequence was ingeniously developed without the need to use other sensors apart from the rotor position sensor 44 located on the motor 21. In a preferred embodiment, this sequence is carried out once a minimum volume of water has been admitted to the tub 11, which, as noted above, is measured by the pressure sensor or pressure switch 41; in an alternative embodiment, the load sensing sequence can be carried out without having previously admitted water to the tub 11 or in another alternative embodiment with the volume of water recovered and not drained from the laundry arrangement sequence 59; in any embodiment, the sequence in question begins when the electronic control 40 sends a signal to the driver 72 of the motor 21, simultaneously the electronic control 40 counts the pulses sent by the rotor position sensor 44, measuring the arc, with a target arc between 180 to 2160 degrees with a frequency of 20 to 220 spm until a certain number of strokes or paddle strokes have been counted. After this period, the agitation continues with a target arc of 180 to 2160 degrees, counting a certain number of paddle strokes that can preferably range between 10 and 40, or for a second period of time that can preferably last between 20 and 40 seconds. It is here, during this second period of time, where after executing each paddle stroke or rotation that preferably oscillates between 180 and 2160 degrees, wherein the electronic control 40, upon detecting that the rotation angle in question has been reached and has interrupted the signal to the driver 72 of the motor 21, begins to count the pulses sent by the rotor position sensor 44 until the agitator or impeller 13 reaches its rest position, which interrupts the string of pulses that the rotor position sensor 44 sends to the electronic control 40; thus, the electronic control 40, upon each paddle stroke or angular path, registers the number of pulses that the rotor position sensor 44 has sent while the motor 21 is de-energized, said data is stored in the memory of the aforementioned electronic control 40, together with the data of the immediately following paddle stroke or angular path in the opposite direction. This pair of data is continuously averaged and stored in memory in such a way that each paddle stroke or angular path is averaged with the immediately following one, erasing the data from the immediately preceding pair of paddle strokes. This happens until the second time interval expires, when this condition takes effect, the last averaged data that remains in the memory of the electronic control 40 is compared with predetermined values obtained from measurements in the laboratory, which indicate the level of water to be used, based on the inertia presented by the amount of water (if any) and objects to be washed inside the basket 10, said data is stored in the memory of the electronic control 40 to be used in the sequence of filling the tub to washing level 61, as well as in the progressive agitation sequence 62, the arrangement and balancing agitation sequence 63, dehydration 64, rinse 65 (in any of its modalities 66, 67).

Sequence of Filling the Tub to Washing Level 61.

Thus, once the size of the load has been determined, water is introduced up to the predetermined level according to the amount of load determined for "high" or "low" water levels (minimum, medium, high, maximum, Aux1, Aux2, for each level, respectively); in this sequence 61 water is filled to the level determined or desired by the user, namely that, in an alternative embodiment of the present invention, the user can determine the level of water to be used, in a preferred alternative embodiment the user can also determine if they want to use "high" or "low" levels of water, which have been mentioned above; in a preferred embodiment, once the amount of objects to be washed inside the basket 10 has been estimated, the electronic control 40 reviews the mode or "setting" of the type of laundry that the user has established, based on these two data it consults a pre-programmed table with which it determines the level of water to be used for the rest of the washing cycle (i.e., progressive agitation sequence 62, arrangement and balancing agitation sequence 63, dehydration sequence 64 and rinse sequence 65 in any of its modalities 66, 67); however, in a preferred embodiment of the present invention, various fill levels are used, which can be seen graphically and as an example in FIG. 5, thus in the figure of the washing machine 20 on the left, the volumes of the "low" levels (minimum, medium, high, maximum, Aux1, Aux2) are marked, noting that the washing machine 20 on the right has the volumes of the "high" levels (minimum, medium, high, maximum, Aux1, Aux2) marked as an example; the "low" levels (minimum, medium, high, maximum, Aux1, Aux2) are useful to maximize water savings during the washing cycle, in view of the type of fabric or materials used in the manufacture of the objects to be washed coupled with their geometry and volume; therefore, the "low" levels are oriented to objects to be washed of small size or small laundry, light fabrics that are usually synthetic such as intimate clothing, lingerie, underwear, baby clothes, among others of similar nature, which can be wash with minor amounts of water or "low" water levels; on the other hand, the "high" levels (minimum, medium, high, maximum, Aux1, Aux2) are oriented to bulky objects to be washed with cotton- or wool-based fabrics that will tend to absorb and retain more water between their fabrics, such as quilts, blankets, bedding, towels, cushions, and even stuffed animals or stuffed cloth objects, winter jackets, etc.; to a lesser degree, "jeans" or denim pants, adult clothing with a large percentage of cotton, among other similar items tend to absorb and retain a large volume of water or wash liquor during the washing cycle; hence the determination of having at least two different types of washing water levels; also, on certain occasions, the experience and preferences of the user can play an important role in the selection of the washing level to be used, thus in an alternative embodiment of the present invention the user can determine the water level that they wish to use or in another preferred embodiment select between "high" or "low" levels via the user interface provided on the washer 20.

Once the required level of water has been determined after having estimated the amount of laundry housed in the basket 10, in addition to taking into account the type of laundry and material with which it has been manufactured, the electronic control 40 selects a particular water level between the "high" and "low" levels available within the tub 11, thus the electronic control 40 sends a signal to the driver 78 of at least one water intake valve 45 to energize the at least one water intake valve 45, allowing water to flow into the tub 11; it is worth mentioning that in a preferred alternative embodiment the electronic control 40 can send a control signal simultaneously or alternately to the corresponding drivers 78 of the corresponding hot water and cold water intake valves (valves 45), simultaneously the electronic control 40 will send control pulses to the driver 72 of the motor 21 to be able to carry out a gentle agitation that helps to uniformly arrange or distribute the objects arranged inside the basket 10, which prevents them from clumping or conglomerating in a single point or area inside the basket 11, the filling and gentle agitation are carried out simultaneously until the level of water has been reached, when this happens, the level sensor or pressure switch 41 sends a signal to the electronic control 40 which, upon receiving it, will stop the control signal to the driver 78 of the at least one filling valve 45 in addition to interrupting the string of control pulses to the controller 72 of the motor 21, thus interrupting the agitation.

Progressive Agitation Sequence 62

The progressive agitation sequence 62 consists of several subsequent progressive agitation patterns within a progressive agitation block (block); namely, that a given pattern of paddle strokes or arcs (rotation of the agitator 13 clockwise and counterclockwise) is determined progressively either incrementally or decrementally, said pattern is built with data on the required arc magnitude (target arc or paddle stroke) in a clockwise (CW) or counterclockwise (CCW) direction, the strokes per minute (spm) or number of times it rotates to each side in a minute and the period that an agitation pattern is performed; in such a way that for a first progressive agitation block a first pattern of paddle strokes or arcs is determined, for a second progressive agitation block a second pattern of paddle strokes or arcs is determined, thus for a block "k" of progressive agitation we have a pattern of paddle strokes or arcs "n" thus forming the progressive agitation sequence 62, which is explained below in conjunction with its modalities.

In general, the arc is determined as a function of the laundry-washing liquid density, power transmission and the capacity of the motor 21 in terms of torque availability; in this respect, the prior art focused on designing a special agitation pattern for each type of laundry, namely that in mechanical washing machines, meaning whose motor is mechanically coupled to a transmission that provides the oscillating CW and CCW movement, the arc was fixed by the design of said transmission; since the electric motor 21 coupled to said transmission worked at a single speed, only the agitation time could be modified to obtain the different washing cycles that could successfully wash the different types of textiles, clothes or objects arranged in the basket 10; however, in an advance of the technique, it was coupled to the electromechanical control of the washing machine 20 with a speed variator based on pulses, frequency, voltage or current, in such a way that it was possible to vary the speed of the motor, this seeking the result of being able to modify the spm, being able to obtain a "gentle" agitation to a "vigorous" agitation, with the same arc length, thus the different washing cycles were based on combinations of spm variations associated with a certain period of agitation; now, from the experience acquired in laboratory tests, it has been determined that an agitating pattern with an arc or paddle that can vary during the washing cycle is beneficial for stain removal, prevents conglomerations or clumping of the objects to be washed, without affecting the scrubbing of the objects to be washed, without increasing the wear or mistreatment of the laundry; thus, taking advantage of this knowledge, the present invention is provided with an electronic control 40 in electronic communication with a driver 72 of the electric motor 21, which consists of a rotor position sensor 44, which in turn is in electronic communication with the electronic control 40 making it possible to have a progressive arc (with both incremental and decremental variance) that can be varied during the agitation sequence, together with the possibility of also progressively varying (with both incremental and decremental variance) the spm during a certain period or time that can also be varied progressively (with both incremental and decremental variance); therefore being able to generate agitation sequences according to the type of material, geometry and volume of the objects to be washed as well as the amount of these (load) arranged in the basket 10.

Now, each stroke or paddle stroke is monitored by comparing its arc length versus the target arc length, said arc measurement being carried out in the preferred embodiment of the present invention by means of a rotor position sensor 44 installed in the motor 24, which reports a certain number of pulses to the electronic control 40 each time the motor 24 is actuated in each direction by means of the driver 72, which receives a control signal from the electronic control 40. Said number of pulses is directly proportional to the arc length, so it is possible to relate a certain number of pulses with a given arc length. Thus, the electronic control 40 compares the pulses measured per stroke or paddle stroke against a certain range of target pulses; the target agitation arc for a certain agitation sequence ranges from 180 to 2160 degrees, obtaining 30 to 100 strokes per minute (spm), which arc lengths allow correct friction between the agitator 13 scrubbers and the objects to be washed, as well as contributing to a better distribution of the objects to be washed inside the basket 10, ensuring that they have an suitable movement of garments; with this in mind, we can think that an efficient washing mode that can be adapted to the type of objects to be washed (i.e., characteristics or manufacturing materials of the fabric, geometry, and volume of the objects to be washed) as well as the amount of load, it being desirable to have a progressive washing pattern in which the agitation parameters can be varied, which, as we have already mentioned, are: the arc or paddle stroke, the spm, and the period during which the agitation pattern or duration of the agitation pattern is carried out. The present invention therefore presents a washing method wherein the period or duration of the agitation pattern in a certain agitation sequence is not fixed as those of the state of the art, but rather the washing patterns can be variable, that is, as mentioned above, for a certain agitation sequence, such as a specialized agitation sequence for washing baby clothes and lingerie (small and delicate garments), only one washing pattern is used in the period or duration in which the agitation sequence is carried out, let's say that there is an arc or paddle stroke of between 180 to 200 degrees, with about 30 to 40 spms, the duration of the agitation sequence being from about 5 minutes to 8 minutes; this supposed special agitation pattern for baby clothes and lingerie does not change during the period or duration in which the washing sequence in question is carried out, therefore, in contrast to the washing method of the present invention, there are a series of agitation patterns for each agitation sequence, that is, the agitation pattern varies during the duration or period in which the washing sequence is carried out, so we can have an "aggressive" agitation pattern that helps remove stains and dirt which is carried out for a first duration, and then gradually "softening" the agitation pattern in subsequent periods or durations when the objects to be washed are no longer as dirty and do not require such excessive scrubbing or agitation; in another case, a "gentle" wash pattern can be used in an initial duration, finishing with a "vigorous" wash pattern in the last duration, thus allowing the objects to be washed to be "soaked" first, gradually loosening the dirt or stains, allowing time for the detergents to affect the dirt, and then ending with a "vigorous" agitation in the final period of the agitation sequence in question.

By way of non-limiting example, a "gentle" agitation pattern for small and delicate garments can be understood as those that have an arc or paddle stroke length of approximately between 180 and 750 degrees and with an spm that oscillates approximately between 20 and 70; a "gentle" agitation pattern for bulky items will have an arc or paddle stroke length of approximately 280 to 750 degrees with a spm of approximately 20 to 70; a "medium" or "moderate" agitation pattern is considered to have an arc or paddle stroke length of approximately 340 to 700 degrees with approximately 40 to 80 spm; a "vigorous" agitation pattern is considered to have an arc length of approximately between 250 to 750 degrees as a general rule, however, as an exception to the general rule we can mention that for small garments (e.g.: lingerie, baby clothes, among others) a "vigorous" arc can be considered to be from 250 degrees to 1080 degrees; thus, arcs greater than 750 degrees to 1080 degrees exerted on objects to be washed other than small garments are considered an exception to the rule, such is the case that by subjecting various garments to arcs greater than 750 degrees they will tend to get tangled or clump together creating an imbalance of the load inside the basket 10; however, with an spm of approximately between 40 to 90.

Progressive Agitation Patterns.

Figure 7:
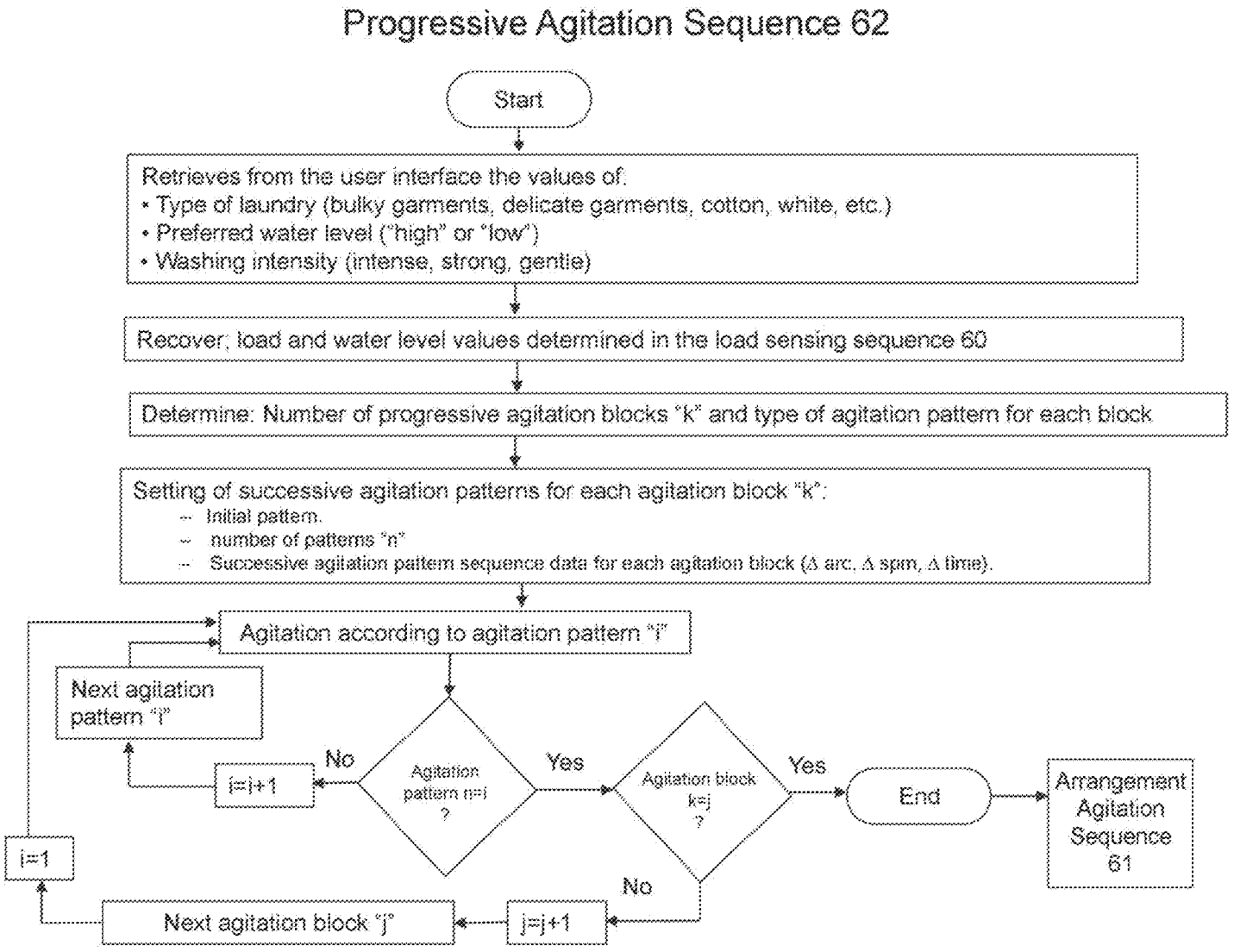
FIG. 7 is a block diagram of the progressive agitation sequence.

In particular, the washing method of the present invention, as illustrated in FIG. 7, the agitation sequence is proposed to be progressive, incrementally as well as decreasingly in blocks (progressive agitation blocks) that are repeated, this will depend on the sequence of specialized or progressive agitation patterns in particular in question, because as already discussed above, the objects to be washed have different levels of dirt, are of a different nature, manufacture, materials, geometry and volume, therefore different types of agitating patterns have been developed to be able to wash them effectively, ensuring as little damage and wear as possible; keeping these ideas in mind, the sequences of progressive agitation patterns (i.e., a concatenation of agitation patterns) that the present invention posits are embedded or nested within a progressive agitation block (block), thus each progressive agitation block is made up of a given sequence of progressive agitation patterns (with increasing or decreasing variances), and a preferred alternative embodiment, the blocks can be repeated successively; however, returning to said progressive washing patterns, they use an initial agitation pattern that is carried out for a certain initial period or duration with initial conditions of arc or paddle stroke length, spm; once the certain initial period or duration has elapsed, there is a second agitation pattern which is carried out for a second period or duration that can be greater or less than the initial period (variance in time or Δtime), the arc or secondary paddle stroke length, for its part, can also be greater or less than the length of the initial arc or paddle stroke (variance in arc or Δarc), as well as the secondary spm can be greater or less than the initial spm (variance in spm or Δspm), and so on until reaching an umpteenth agitation pattern within a block, wherein the period or duration can be greater or less than that used for the immediately preceding period or span, something similar happens with the arc or paddle stroke wherein this can be greater or less than the immediately preceding arc or paddle stroke length; for their part, the spm are in the same context, wherein the nth spm can be greater or less than the immediately previous spm; however, the difference or variance between the nth period or duration and the immediately preceding period or duration (n−1) can be considered as Δtime or variance in time, similarly, there are values of Δarc or variance in arc, which represents the difference or variance between the length of the nth arc or paddle stroke and the length of the immediately preceding arc or paddle stroke (n−1); along the same line of thought, we have the Δspm value or variance in spm, which represents the difference or variance between the nth spm value and the immediately previous spm value (n−1); thus, in a preferred embodiment we have the agitation patterns made up of: the variance values of the agitation pattern (i.e., Δtime, Δarc, Δspm), in addition to the initial values of the agitation pattern (i.e., period or duration (time), arc and spm), which are fixed values determined based on laboratory tests for different types of objects to be washed (i.e., materials, manufacture, geometry, volume, among others), loads, water levels and degrees of dirt, said determined values of Δtime, Δarc, Δspm, number of patterns "n" that a block must have, as well as the number of blocks "k", among other initial values of period or duration, arc length and spm, to be carried out in a certain sequence of agitation patterns are stored in the memory of the electronic control 40 which will recover them based on the type of laundry selected in the user interface of the washing machine 20, together with other user preferences such as: "high" or "low" water levels, and wash intensity.

The electronic control 40, in addition to recovering the data of the load inside the basket 10, the water level determined in the load sensing sequence 60, the type of agitation pattern determined for the progressive agitation block in course, with which the initial values or values of the first agitation pattern will be determined, number of progressive agitation patterns "n" within a block, number of blocks "k" required in addition to the decreasing or increasing values of the particular sequence of agitation patterns in question.

To illustrate the foregoing, we can assume by way of example that delicate laundry such as lingerie will not require a sequence of vigorous agitation patterns, but rather a sequence of gentle agitation patterns in a single progressive agitation block; however, continuing with our example, we can now assume that for baby clothes the first progressive washing block would be required to have a sequence of "gentle" tending to "moderate" washing patterns.

As mentioned above, the user will have to indicate via the user interface arranged on the top 31 the intensity of washing (strong, intense, gentle) with which the user in some way qualitatively indicates the level of dirt on the laundry or the intensity with which it can be treated during the washing process, the water level selected by the user ("high" or "low"), as well as the type of laundry in question (whites, baby, lingerie, towels, sheets, cotton, synthetic, etc.), also considering the load detected or determined inside the basket 10 and the water level determined in the load determination or sensing sequence 60; with these data, as previously mentioned, the electronic control 40 determines by means of a table of values obtained through laboratory tests, which is stored in the memory of the electronic control 40, the type of agitation pattern for each block, which will be used to determine the sequence and number of agitation patterns in particular for each block, including the start data for the first agitation pattern of each block.

Figure 8:
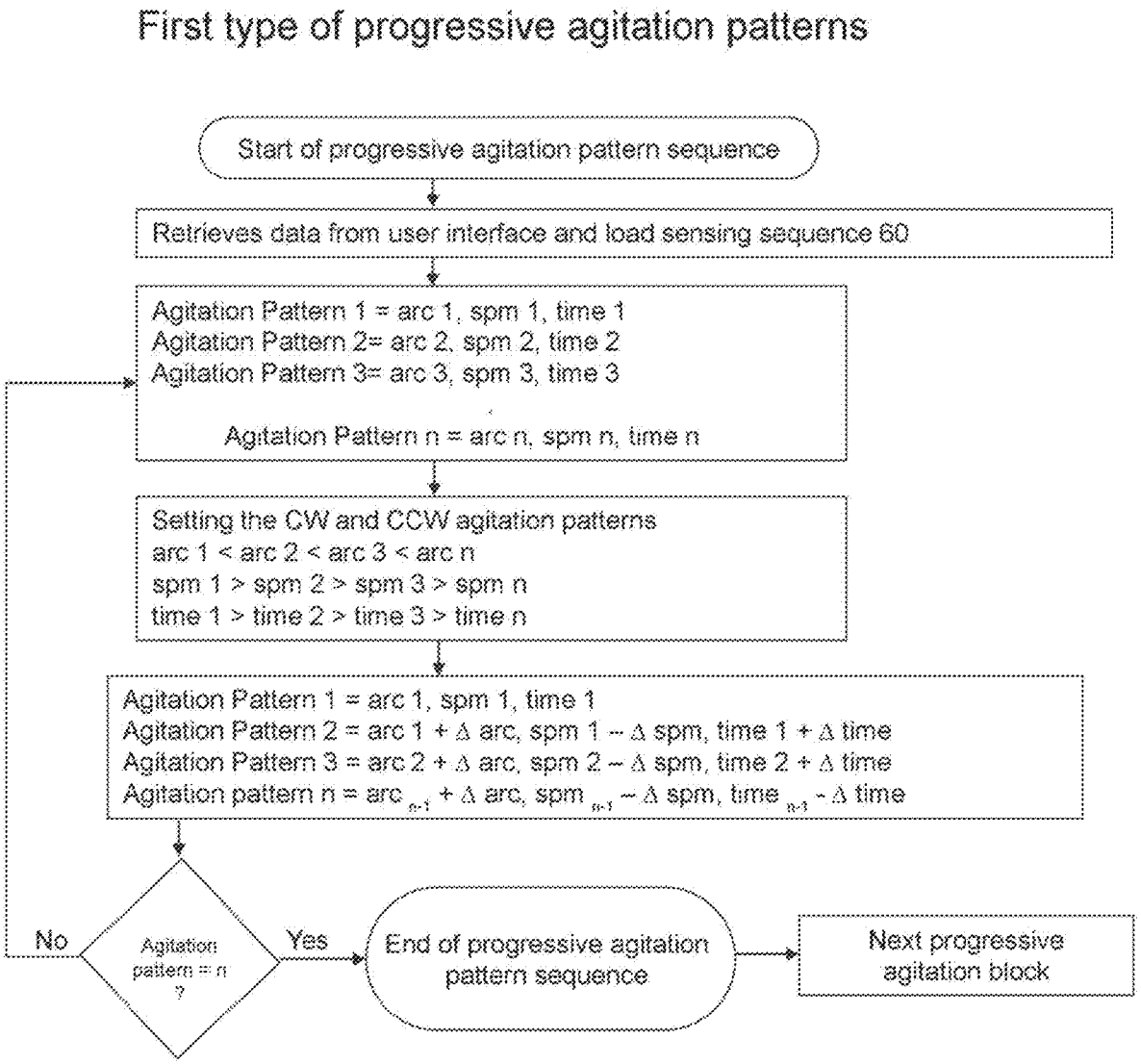
FIG. 8 is a block diagram of the first exemplary embodiment of progressive agitation pattern sequences.
Figure 9:
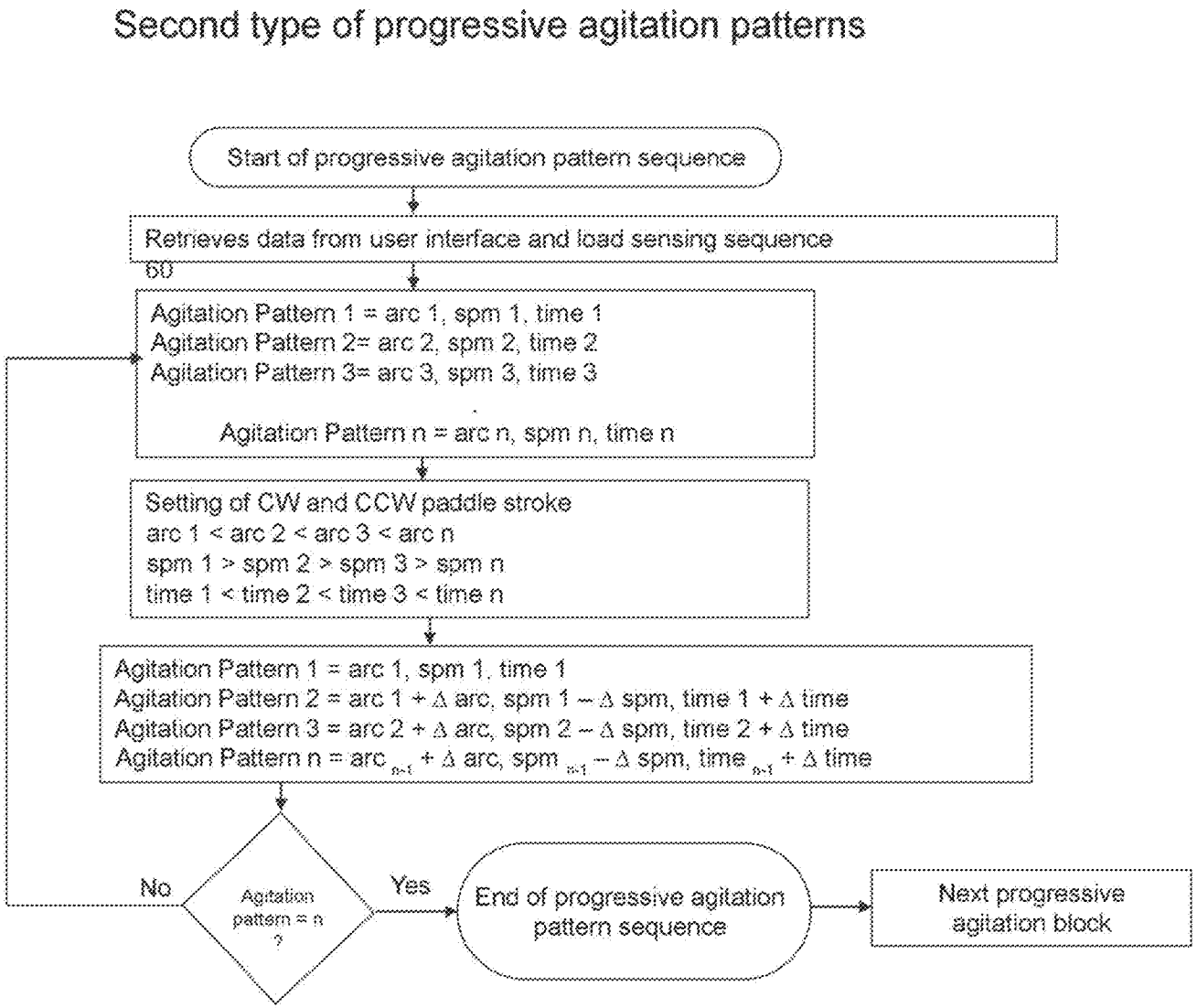
FIG. 9 is a block diagram of the second exemplary embodiment of progressive agitation pattern sequences.
Figure 10:
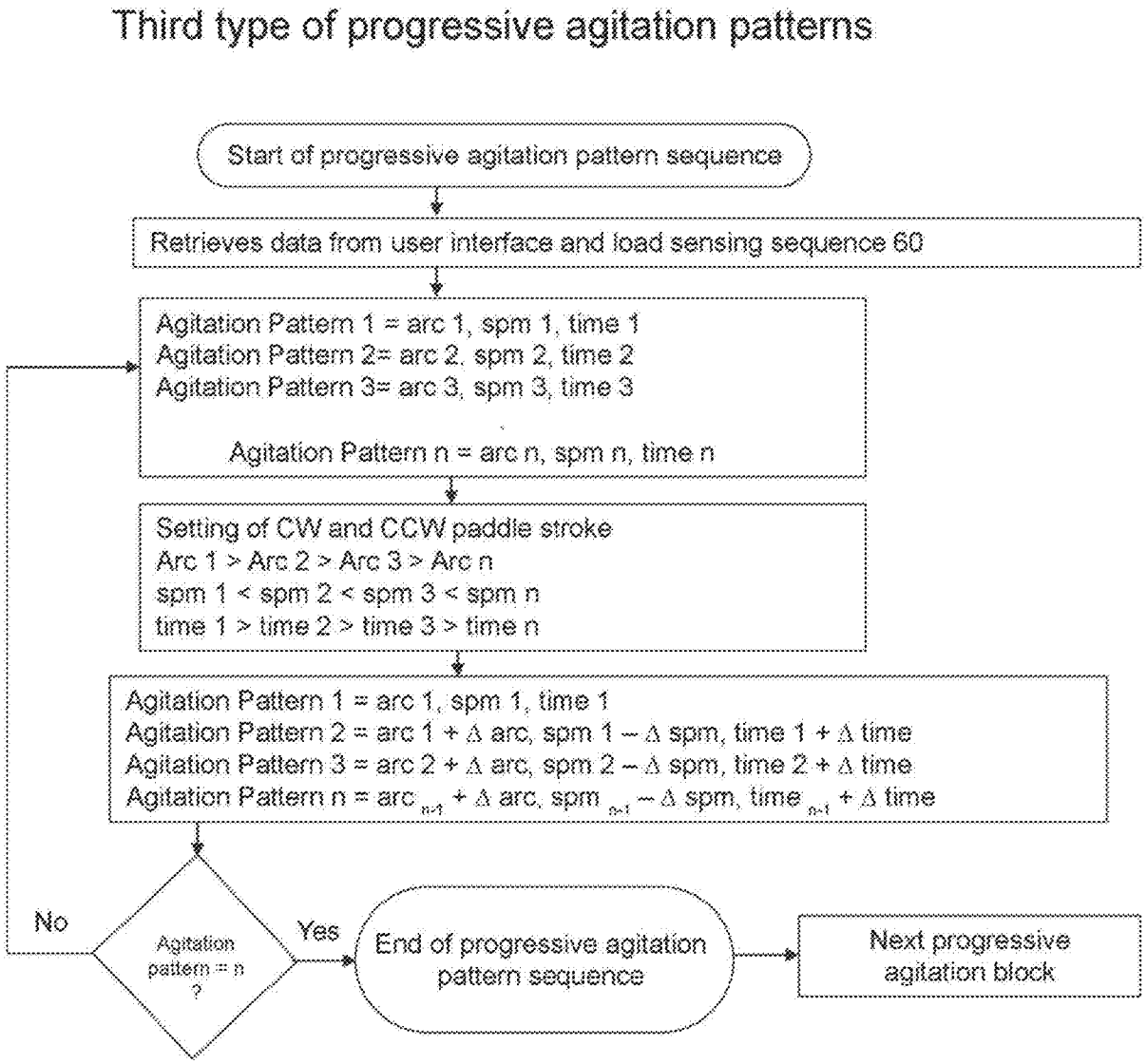
FIG. 10 is a block diagram of the third exemplary embodiment of progressive agitation pattern sequences.

Now, by way of non-limiting example, three types or modalities of progressive agitation pattern sequences are presented that are part of the present invention and that can form a progressive agitation block; said exemplary modalities or types of progressive agitation pattern sequences are illustrated in FIGS. 8, 9, 10, respectively, which we will discuss below: thus we have that the first type of progressive agitation pattern sequence or first exemplary embodiment of progressive agitation pattern sequences is illustrated in FIG. 8; the agitation pattern is that the period or duration of each agitation pattern will decrease in a certain Δtime, in such a way that the initial agitation pattern will have a longer duration than the secondary agitation pattern, and so on until the nth agitation pattern that will last less than the immediately preceding agitation pattern (n−1); for its part, the length of the arc or paddle stroke will be incremental, increasing a value of Δarc given in each subsequent agitation pattern, thus the length of the nth arc or paddle stroke will be greater than the length of the immediately preceding arc or paddle stroke (n−1); regarding the spm, we can observe in FIG. 8 that these are also decreasing, so the nth value of each spm will be less than the value of the immediately preceding spm (n−1) by an amount equal to Δspm; in a didactic and exemplary way we can consider the following scenario: the user has selected high water levels, bulky garments (towels or sheets), a "strong" wash intensity in the user interface of the washing machine 20, and has introduced in the basket 10 a load of approximately eighteen pounds of objects to be washed; once the load sensing sequence 60 and the tub filling sequence have been carried out, the electronic control 40 has registered a load of approximately eighteen pounds, and therefore allowed the entry of approximately eighty-six liters of water into the tub 11; in this scenario, the electronic control 40 retrieved a Δarc value of 90 degrees, a Δspm value of 10, a Δtime value of 2 minutes, the number of patterns "n" to use in this exemplary agitation sequence is four, with initial arc or paddle stroke values of 360, 70 spm and duration of the initial agitation pattern of 7 minutes; the values of each particular exemplary agitation pattern are summarized in the following table:

TABLE 1 exemplary values of the first type of agitation pattern sequences.

| "i" agitation pattern number | Value in degrees of the length of the arc or paddle stroke | Spm (strokes per minute) value | Period during which the agitation pattern is carried out in minutes. |
|---|---|---|---|
| 1 | 360 | 70 | 7 |
| 2 | 450 | 60 | 5 |
| 3 | 540 | 50 | 3 |
| 4 | 630 | 40 | 1 |

The second type of agitation pattern sequence or second exemplary embodiment of progressive agitation pattern sequences is illustrated in FIG. 9; the agitation pattern establishes that the period or duration of each agitation pattern will be incremental in a certain Δtime, in such a way that the initial agitation pattern will have a shorter duration than the secondary agitation pattern, and so on until the nth agitation pattern, which will last longer than the immediately preceding agitation pattern (n−1); for its part, the length of the arc or paddle stroke will be incremental, increasing a given value of Δarc in each subsequent agitation pattern, thus the length of the nth arc or paddle stroke will be greater than the length of the immediately preceding arc or paddle stroke (n−1); regarding the spm we can see from FIG. 9 that these are decreasing, so the nth value of the spm will be less than the value of the immediately previous spm (n−1) by an amount equal to Δspm; in a didactic way we can consider the following scenario: the user has selected low water levels, denim pants "jeans", "intense" washing intensity, in the user interface of the washing machine 20, and has introduced a load of approximately nine pounds of objects to be washed into the basket 10; once the load sensing sequence 60 and the tub filling sequence have been carried out, the electronic control 40 registered a load of nine pounds, therefore allowing the entry of fifty-four liters of water into the tub 11; in this scenario, the electronic control 40 retrieved an Δarc value of 90 degrees, an Δspm value of 20, a Δtime value of 2 minutes, the number of patterns "n" to use in this exemplary agitation sequence is five, with initial length of arc or paddle stroke values of 360, at 40 spm and a period or duration of the initial agitation pattern of 2 minutes; the values of each particular exemplary agitation pattern are summarized in the following table:

TABLE 2 exemplary values of the second type of agitation pattern.

| "i" agitation pattern number | Value in degrees of the length of the arc or paddle stroke | Spm (strokes per minute) value | Period during which the agitation pattern is carried out in minutes. |
|---|---|---|---|
| 1 | 360 | 70 | 2 |
| 2 | 450 | 60 | 4 |
| 3 | 540 | 50 | 6 |
| 4 | 630 | 40 | 8 |
| 5 | 720 | 30 | 10 |

The third type of agitation pattern sequence or third exemplary embodiment of progressive agitation pattern sequences is illustrated in FIG. 10; the agitation pattern establishes that the period or duration of each agitation pattern will decrease in a certain Δtime, in such a way that the initial agitation pattern will have a longer duration than the secondary agitation pattern, and so on until the nth agitation pattern, which will last less than the immediately preceding agitation pattern (n−1); for its part, the length of the arc or paddle stroke will decrease, decreasing a given value of Δarc in each subsequent agitation pattern, thus the length of the nth arc or paddle stroke will be less than the length of the immediately preceding arc or paddle stroke (n−1); regarding the spm we can see from FIG. 10 that these are incremental, so the nth value of the spm will be greater than the value of the immediately previous spm (n−1) by an amount equal to Δspm; in a didactic way we can consider the following scenario: the user has selected: high water levels, bedspreads and duvets, "gentle" wash intensity on the selector knobs arranged on the user interface of the washing machine 20, and has introduced into the basket 10 a load of approximately nineteen pounds of objects to be washed; once the load sensing sequence 60 and the tub filling sequence have been carried out, the electronic control 40 has registered a load of nineteen pounds, therefore allowing the entry of eighty-six liters of water to the tub 11, in this scenario, the electronic control 40 retrieved a value of Δarc of 90 degrees, a value of Δspm of 5, a value of Δtime of 3 minutes, the number of patterns "n" to use in this exemplary agitation sequence is five, with initial arc or paddle stroke values of 720, at 35 spm and a period or duration of the initial agitation pattern of 14 minutes; the values of each particular exemplary agitation pattern are summarized in the following table:

TABLE 3 exemplary values of the third type of agitation pattern.

| "i" agitation pattern number | Value in degrees of the length of the arc or paddle stroke | Spm (strokes per minute) value | Period during which the agitation pattern is carried out in minutes. |
|---|---|---|---|
| 1 | 720 | 35 | 14 |
| 2 | 630 | 40 | 11 |
| 3 | 540 | 55 | 8 |
| 4 | 450 | 60 | 5 |
| 5 | 360 | 65 | 1 |

Progressive Agitation Block.

As mentioned above and as can be observed in FIG. 7, a progressive agitation block (block) is made up of a given sequence of progressive agitation patterns (increasing or decreasing), being that in a preferred alternative embodiment the progressive agitation block can be repeated successively a "k" number of times, in such a way that once the i-th agitation pattern "i" has been carried out, meaning that when the pattern number "i" is equal to the value "n" of target agitation patterns to be used in a given "jth" block, the electronic control 40 proceeds to verify if the number of the "jth" agitation block is equal to the predetermined number "k" (target) of agitation blocks, if so, the electronic control 40 proceeds to carry out the arrangement and balancing agitation sequence 63 (see FIG. 6); otherwise, it means that there are "j-th" progressive agitation blocks pending, so the electronic control 40 gives way to the new subsequent "j-th" block (i.e., j+1) updating the "j" block counter; immediately afterwards, the electronic control 40 recovers the data of the progressive agitation patterns (i.e., i=1 to i=n) that made up the block k=1; once this task has been carried out, the electronic control 40 proceeds to repeat the progressive agitation patterns in question, thus subjecting the objects to be washed to a new progressive agitation block, that is, to move the agitator or propeller 13 according to the progressive agitation pattern sequence that makes up the block until the condition of number of blocks k=j is met.

For ease of comprehension of the agitation sequence 62 illustrated in FIG. 7, let us assume the following scenario as an example, as well as a didactic one: the user has selected "low" levels of water, small items, an "intense" washing intensity, in the user interface of the washer 20, and has loaded into the basket 10 a load of approximately 7 pounds of objects to be washed; once the load sensing sequence 60 and the tub filling sequence have been carried out, the electronic control 40 has registered a load of approximately 7 pounds, thus allowing the entry of approximately forty-eight liters of water into the tub 11; in this scenario, the electronic control 40 determines that two stir blocks are required (k=2); immediately afterwards, the electronic control 40 begins the configuration of the successive agitation patterns, so the electronic control 40 recovers a value of Δarc of 120 degrees, a value of Δspm of 10, a value of Δtime of 3 minutes, the number of patterns "n" to be used in this exemplary agitation sequence is four, with initial values of arc or paddle stroke length of 270, at 70 spm and a period or duration of the initial agitation pattern of 3 minutes; the values of each particular exemplary agitation pattern are summarized in the following table:

TABLE 4 exemplary values of the first progressive agitation block.

| "i" agitation pattern number | Value in degrees of the length of the arc or paddle stroke | Spm (strokes per minute) value | Period during which the agitation pattern is carried out in minutes. |
|---|---|---|---|
| 1 | 270 | 70 | 1 |
| 2 | 390 | 60 | 4 |
| 3 | 510 | 50 | 7 |
| 4 | 630 | 40 | 10 |

Once the last agitation pattern (i=4) has been carried out, the electronic control 40, by comparing the value "i" with the target number of patterns "n", determines that the condition (i=n) has been met, then proceeding to compare the value "j" of the current agitation block with the objective value "k", wherein it determines that the condition (k=j) has NOT been met, immediately afterwards the electronic control 40 increases the agitation block counter (j+1) and moves on to the next agitation block (j=2); when doing this, the electronic control 40 recovers the values of the block j=1 that in our example are displayed in table 4, and having done this, the electronic control 40 acts again on the agitator or propeller 13 according to the agitation patterns that make up the block.

Once the last agitation pattern (i=4) of this second agitation block (j=2) has been carried out, the electronic control 40, by comparing the value "i" with the objective number of patterns "n" determines that the condition (i=n) has been met, then proceeding to compare the value "j" of the current agitation block with the objective value "k", wherein it determines that the condition (j=k) has been met, so the progressive agitation sequence 62 is considered to be completed, giving way to the arrangement and balancing agitation sequence 63 of the load or objects to be washed inside the basket 10.

Arrangement and Balancing Agitation Sequence 63

The purpose of this special agitation sequence is to evenly distribute or spread the objects to be washed within the basket 10 within the work volume contained within the basket 10, to avoid imbalance in the dehydration or spin stage as much as possible. The basket 10 in said spin stage rotates at high revolutions, and it is always desirable to have the load or objects to be washed inside the basket 10 as evenly distributed as possible within the work volume, avoiding clumps or high densities of laundry in a reduced volume that could cause an imbalance in the basket 10. Thus, while the clutch is in agitation mode, the electronic control 40 orders a paddle stroke with a target arc of 180 degrees to 550 degrees, with such a frequency as to obtain between 30 to 90 spm, for a period of between 1 to 20 minutes.

Dehydration 64

The dehydration stage serves to extract the wash liquor. This sequence is carried out by rotating the basket 10 so that, by centrifugal force, the wash liquor approaches the wall with holes of the basket 10 to be evacuated through said holes towards the tub 11, wherein the extracted wash liquor is pumped to the outside by means of the drain pump 35, which has a drain hose 16 connected to its outlet. The electronic control 40 then sends a pulse for a certain time of between 2 to 8 minutes to the driver 75 of the drain pump 35; at the same time, it also sends a signal to the driver 73 of the clutch 28 for it to change from agitation mode to dehydration mode. In an alternative embodiment of the present invention, the clutch can be a floating clutch that, in the presence or absence of wash liquor, can engage or disengage shafts 25 and 26, it being evident that said floating clutch would not use an actuator, so the electronic control will not be able to send any signal to activate or deactivate it. Thus, when the clutch is in dehydration mode, the electronic control also sends a pulse for a certain period of time to the driver 72 so that it energizes the motor 21, thus rotating the basket 10 in unison with the agitator or propeller 13. The aforementioned pulse sent by the electronic control 40 can vary depending on the type of spin desired. Thus, in an alternative embodiment, it is even possible to send a string of pulses of varied widths with the aim of accelerating and decelerating the basket 10 in order to extract less water by decelerating the basket, giving the drain pump 35 time to extract the wash liquor accumulated in the bottom of the tub 11, in addition to avoiding problems with the accumulation of foam between the tub 11 and the basket 10, causing the phenomenon called "sudsing".

In an alternative embodiment of the present invention, the motor 24 can be energized intermittently, allowing the basket 12 to slow down, giving the pump time to dislodge the wash liquor accumulated in the bottom of the tub, in an effort to avoid "sudsing", which is created due to the accumulation of water at the bottom of the tub in such a way that when the wash liquor comes into contact with the basket while it rotates, the friction causes the wash liquor coupled with the speed with which said wash liquor is projected on the circular wall of the tub 11 to generate a high concentration of foam between the annular space of the basket and the tub, which can cause the basket 12 to stop and the energized motor 24 to suddenly increase its temperature. Some other method for the prevention or management of "sudsing" available in the state of the art may be used.

Rinse 65

The rinse stage removes the residues of detergent, additives or chemicals dissolved in the wash liquor remaining in the objects to be washed. This can be done in various ways; in the present invention, two ways of rinsing are considered, which are: deep rinse 67 and spray rinse 66; which will be discussed in detail below; at this point, as can be seen in FIG. 6, the electronic control 40 has completed the dehydration stage 64, wherein the drain pump 35 has extracted the wash liquor accumulated at the bottom of the tub 11, making it evident that the objects to be washed inside the basket 10 are dehydrated, retaining in their manufacturing materials (fabric or fibers) a high amount of detergent, which for obvious reasons is undesirable in the textiles, fibers or materials of the objects to be washed; thus, to remove the remaining wash liquor, in addition to removing the detergent trapped in the textiles or fibers of the objects to be washed, a rinsing process is required, wherein fresh water is used to help remove the remaining wash liquor and detergent in the objects to be washed; the present invention contemplates two ways of carrying out the rinsing process, one of them is the "traditional" way, wherein the tub 11 is filled with fresh water up to a certain level and then proceeds to agitation by means of the agitator or propeller 13 for a certain period of time; immediately afterwards, the wash liquor is extracted by means of the drain pump 35, which is in fluid communication with a drain hose that transports the water out of the tub 11 and to the drain of the house or place where the washing machine 20 is operating and the objects to be washed contained in the basket 10 are spun; the other way of rinsing that the present invention proposes is by means of a spray rinse, that is, contrary to the "traditional" deep rinse where a certain volume of fresh water is allowed to enter the tub 11 and is then sprayed by means of a deflector 18 arranged in the cover 14, which is in fluid connection with a spray pump 15 by means of a spray hose 17, this allows taking water from the bottom of the tub 11 and spraying it on the upper surface of the objects to be washed arranged in the basket 10; immediately afterwards the basket is rotated and water is sprayed again, repeating this operation until at least one revolution of the basket 10 has been achieved; the present invention then allows the user to choose the form of rinsing, thus in the user interface of the washing machine 20, the user can choose between "deep rinse 67" or "spray rinse 66"; once again, when the electronic control 40 has completed the dehydration 64, it retrieves from the user interface of the washing machine 20 the rinse method selected by the user as well as the water level (high or low), and the type of laundry, also retrieving the data on the laundry load determined in the load sensing sequence 60, as well as the water level used in the progressive agitation sequence 62, at this point, the electronic control 40 makes sure that there is no water or wash liquor inside the tub 11 by taking and analyzing the signal from the pressure sensor or pressure switch 41; immediately afterwards, the electronic control 40 will carry out the corresponding rinse block (66 or 67).

Spray Rinse Sequence 66

This sequence as a preferred alternative embodiment of the washing method, object of the present invention; namely, that this spray rinse 66 sequence allows saving water in the process of rinsing the objects to be washed arranged in the basket 10; carrying out the spray rinse 66 requires that the clutch 28 be in spin mode, in addition to admitting a minimum amount of fresh water to the tub.

In a preferred embodiment of the spray rinse sequence 66 the electronic control 40 sends a control pulse to the driver 78 of the water intake valve 45, which promotes the passage of water into the tub 11, this happens until the pressure sensor or pressure switch 41 sends a control signal to the electronic control 40 that the desired water level has been reached; immediately afterwards, the electronic control 40 sends a pulse for a certain period of time which can oscillate between 0.5 seconds to 2 seconds to the driver 71 of the spray pump 15 so that it sends water towards the spray deflector 18 through the spray hose 17, in order to soak the objects to be washed inside the basket 10 that are exposed or at the top. Immediately afterwards, the electronic control 40 counts a certain waiting time; once elapsed, the electronic control 40 sends a control pulse to the driver 72 of the motor 21 so that it makes a paddle stroke of between approximately 30 degrees to 60 degrees with the aim of positioning a different section of the basket 10 under the deflector of spray 18, promoting the wetting of another section of objects to be washed by receiving the water that is expelled from the spray deflector 18; these steps are repeated until the basket 10 has been rotated at least 360 degrees (one revolution); once the objects to be washed have been hydrated (i.e., the objects to be washed have received the water ejected by the spray deflector 18 and the basket 10 has been rotated at least one revolution), the electronic control 40 orders the basket 10 to be spun for a certain period that oscillates between 1 min and 10 min; to do this, the electronic control 40 orders the motor driver 72 to energize, causing the basket 10 to rotate, subjecting the objects contained in it to a centrifugal force, causing the wash liquor to approach the wall with holes of the basket 10 and to be evacuated through said holes towards the tub 11, wherein the extracted wash liquor is pumped outside by means of the drain pump 35 that has a drain hose 16 connected to its outlet, thus while the motor 21 is energized the drain pump 35 is energized, sensing once the spin period has elapsed, the electronic control 40 jointly de-energizes the motor 21 and the drain pump 35; it should be noted at this point that it is the electronic control 40 that determines the volume of water that is introduced into the tub 11, the number of times that the basket 11 will be rotated to spray the objects to be washed under the spray deflector 18 and the spin period, thanks to a table obtained from experimental values in the laboratory and stored in its memory based on the laundry load detected, the type of laundry, and the level of water used.

An alternative embodiment of the present spray rinse sequence 66 comprises the use of a directional valve 36, the inlet of which is in fluid connection with the outlet of the drain pump 36 by means of a duct or hose (not shown). One of the outlets of the aforementioned directional valve 36 is connected to the spray hose 17 and the rest to the drain hose 16.

As in the previous embodiment, the entry of a certain volume of fresh water into the tub 11 is promoted, which will be sprayed onto the objects to be washed inside the basket 10; for this embodiment said volume of water inside the tub 11 is greater than or equal to the mean water level for any case of water level i.e., "high" or "low" levels (see FIG. 5); the electronic control 40 sends a pulse for a certain period of time, which can range from 0.5 seconds to 2 seconds, to the driver 75 of the drain pump 35; at the same time, it sends a pulse for the same certain period of time to the driver 76 of the directional valve 36 so that it sends water towards the spray deflector 18 through the spray hose 17 in order to soak the objects to be washed inside the basket 10 below the spray deflector. Immediately afterwards, the electronic control 40 counts a certain waiting time. Once this time has elapsed, the electronic control 40 sends a control pulse to the driver 72 of the motor 21 that causes a movement of the basket 10 of approximately between 30 degrees to 60 degrees with the aim of positioning a different section of the basket 10 under the spray deflector 18, promoting the wetting of another section of objects to be washed by receiving the water that the spray deflector 18 expels; these steps are repeated until the basket 11 has been rotated at least 360 degrees (one revolution); once the objects to be washed have been hydrated (i.e., the objects to be washed have received the water ejected by the spray deflector 18 and the basket 10 has been rotated at least one revolution), the electronic control 40 orders the basket 10 to be spun for a certain period that oscillates between 1 min and 10 min; to do this, the electronic control 40 orders both the driver 76 of the directional valve 36 so that it sends the wash liquor inside the tub 11 to the outside of the washing machine 20 through the drain hose 16, and at the same time commands the motor driver 72 to energize causing the basket 10 to rotate, subjecting the objects contained in it to a centrifugal force, causing the wash liquor to approach the wall with holes of the basket 10 and to be evacuated through said holes to the tub 11, wherein the extracted wash liquor is pumped outside by the drain pump 35, which is in fluid connection with the drain hose 16 by means of the directional valve 36; thus, while the motor 21 is energized the direction of the directional valve 36 is changed and the drain pump 35 is energized, noting that once the spin period is over, the electronic control 40 jointly de-energizes the motor 21 and the drain pump 35 coupled with the change of direction of the directional valve 36; it should be noted at this point that it is the electronic control 40 that determines the volume of water that is entered into the tub 11, the number of times that the basket 11 will be rotated to spray the objects to be washed under the spray deflector 18, and the spin period, thanks to a table obtained from experimental values in the laboratory and stored in its memory based on the laundry load detected, the type of laundry, and the level of water used.

In an alternative preferred mode of spray rinse 66, a certain volume of water is allowed to enter (which depends on the load size determined during the load sensing sequence 60), to then be sprayed by means of the spray pump 15 onto the objects to be washed contained in the basket 10, while the basket 10 rotates at a constant low speed that allows the centrifugal force that the rotation of the basket 10 exerts on the objects to be washed and allowing the passage of fresh water through the textiles or fibers from the objects to be washed, thus hydrating the objects to be washed and at the same time removing the wash liquor, which is recovered by the cylindrical wall and bottom of the tub 10; for this, as in the previous embodiment, the entry of a certain volume of fresh water into the tub 11 is promoted, which will be sprayed onto the objects to be washed inside the basket 10; for this embodiment said volume of water within the tub 11 is greater than or equal to the average water level in any case, i.e., "high" or "low" levels (see FIG. 5); thus, in the present embodiment the electronic control 40 sends a control pulse to at least one driver 78 of at least one filling valve 45 promoting the flow of water into the tub 11 as well as the relevant accumulation of water inside it; however, when the electronic control 40 detects through the signals emitted by the pressure sensor 41 that the minimum level in any of the cases of water levels in which it is operating, i.e., "high" or "low", the electronic control 40 initializes a timer that will stop when the electronic control 40 determines through the signals emitted by the pressure sensor 40 that the average level of the level case in question has been reached, said time data will be stored in the memory of the microprocessor of the electronic control 40, calling it: "tfill", as it will be used in the future; continuing, the electronic control 40 now sends a pulse for a certain period of time to the driver 71 of the spray pump 15 with the particularity that the value of said period of time value is approximated to the time value of "tfill" (which can range from 1 minute to 10 minutes) noting that in this mode the spray pump 15 has a fluid connection with the deflector 18 by means of the hose 17; it should be noted at this point that in an alternative mode, the electronic control 40 sends a control pulse whose time value is approximated to the time value of "tfill" (which can range from 1 min. to 10 min.) to the driver 75 of the drain pump 35 and at the same time sends a pulse for the same certain period of time (which is also approximated to the time value of "tfill") to the driver 76 of the directional valve 36 so that it sends water towards the deflector spray hose 18 via the spray hose 17; in any of the modes, the deflector 18 emits a fan of water onto the objects to be washed that are instantly below it while the basket 10 rotates, thus hydrating or soaking them; for this purpose, with the basket 10 in spin mode, at the same time that the electronic control 40 acts for a time approximated to the time value of "tfill" to one of the pumps 15 or 35 depending on the mode, it sends a control pulse to the driver 72 of the motor 21 for a period of time approximated to the time value of "tfill" so that it rotates and promotes the movement in unison of the basket 10 with the agitator or propeller 13 (spin mode) at a speed of rotation between 5 rpm to 100 rpm, making the objects to be washed rotate inside said basket 10 so that a section of these when passing under the spray nozzle 18 will be subjected to the fan of water emanating from the spray nozzle 18, hydrating them in this way and promoting a slow dehydration by spinning, which causes the water sprayed on the top or surface of the objects to be washed in the basket 10 to permeate the objects to be washed during its journey between the textiles and fibers of the aforementioned objects to be washed until it reaches the circular wall or bottom of the basket 10, dragging the detergent or wash liquor with it during its journey or path and depositing it inside the tub 11; as can be seen from the description above, the time that one of the pumps 15 or 35, depending on the mode, is energized, as well as the time that the motor 21 is energized, making the basket 10 rotate, is approximately the time value of "tfill"; in another preferred alternative embodiment of the present spray rinse mode 66, once the approximate time value of "tfill" has elapsed and the electronic control 40 has de-energized either of the pumps 15 or 35 depending on the mode, as well as the motor 21, the electronic control 40 sends a control pulse to the driver 75 of the drain pump 35 (and, if applicable, to the driver 76 of the directional valve to operate in drain mode) to dislodge the wash liquor contained at the bottom of the tub 11, the duration in time of the pulse being between 0.5 minutes and 5 minutes depending on the case of the water levels ("high" or "low") used; thus, once the duration of the referred control pulse to the driver 75 of the drain pump 35 expires, said pump 35 is de-energized, starting over again this spray rinse mode, so that the electronic control 40 again promotes the entry of a certain volume of water into the tub 11 and continues with the steps described above for the present mode.

In any embodiment of the spray rinse block 66, once the wash liquor is extracted from the tub 11 by means of the drain pump 35 that has a drain hose 16 connected to its outlet that leads the liquid to the outside of the tub 11, preferably towards the drain of the place wherein the washing machine 20 is operating; once the liquid has been drained from the tub 11, which is verified when the electronic control 40 the signal emitted by the pressure sensor or pressure switch 41 indicates this fact, with the tub 11 in the absence of liquid and spin mode to spin in unison the basket 10 with the propeller 13 centrifuging the basket 10 for a certain period that oscillates between 1 min. and 5 min.; to do this, the electronic control 40 orders the motor driver 72 to energize, causing the basket 10 to rotate, subjecting the objects contained in it to a centrifugal force, causing the wash liquor to approach the wall with holes of the basket 10 and to be evacuated through said holes towards the tub 11, where the extracted wash liquor is pumped outside by means of the drain pump 35 that has a drain hose 16 connected to its outlet (or, where appropriate, a directional valve 36 that in turn has one of its outlets fluidly connected to the drain hose 16), so while the motor 21 is energized, the drain pump 35 is energized (and, when appropriate, the directional valve so that it is in drain mode) noting once the period of spinning has expired, the electronic control 40 de-energizes the motor 21 and the drain pump 35 together.

In an alternative embodiment, any of the modes of the spray rinse block 66 described herein is repeated at least once.

Deep Rinse 67

In case the electronic control 40 has determined that the user has selected the use of a deep rinse, that is, the electronic control 40 detects that the user determined the use of the deep rinse in the user interface of the washing machine 20, the electronic control 40 arranges for the clutch 28 to be in agitation mode; once the change has been made or it has been verified that the clutch 28 is in agitation mode the electronic control is ready to admit fresh water into the tub 11 up to the level used for the progressive agitation sequence 62; to do this the electronic control 40 sends a control pulse to the driver 78 of the water intake valve 45, which promotes the passage of water into the tub 11; this happens until the pressure sensor or pressure switch 41 sends a control signal to the electronic control 40 that the desired water level has been reached (level used for the progressive agitation sequence 62), to then proceed to agitate by means of the agitator or propeller 13 for a certain period of time preferably between 1 minute and 8 minutes, the electronic control 40 determining the duration of said agitation period in addition to the agitation pattern to be used, and the spinning period, by checking a table obtained from experimental values in the laboratory and stored in its memory based on the laundry load detected, the type of laundry, and level of water used. Immediately afterwards, the electronic control 40, once the agitation period has ended, the wash liquor is extracted from the tub 11 by means of the drain pump 35, which has a drain hose 16 connected to its outlet that preferably leads the liquid to the outside of the tub 11 towards the drain of the place where the washing machine 20 is operating; once the liquid has been drained from the tub 11, which is verified when the electronic control 40 the signal emitted by the pressure sensor or pressure switch 41 indicating this fact, with the tub 11 in the absence of liquid, the electronic control 40 changes the state of the clutch 28 to spinning mode, sending a signal to the driver 73 of the clutch 28 to make the change from agitation mode to dehydration mode, to then spin the basket 10 for a certain period that oscillates between 1 min. and 5 min.; to do this, the electronic control 40 sends a command to the motor driver 72 to energize, causing the basket 10 to rotate, subjecting the objects it contains to a centrifugal force, causing the wash liquor to approach the wall with holes of the basket 10 and to be evacuated through said holes towards the tub 11, wherein the extracted wash liquor is pumped outside by means of the drain pump 35 that has a drain hose 16 connected to its outlet, thus while the motor 21 is energized the drain pump 35 is energized, sensing once the spin period expires the electronic control 40 jointly de-energizes the motor 21 and the drain pump 35.

In an alternative embodiment, the deep rinse block 67 described herein is repeated at least once.

Washing Method.

The method of the washing method object of the present invention referred to in FIG. 6 begins when the user has introduced a certain amount of items to be washed, a certain corresponding amount of washing additives, selected the program to be used, selected the desired water level if appropriate or if the washing machine 20 should be operated at high tub 11 fill levels or low tub 11 fill levels of (see FIG. 5) and has instructed the washing machine 20 to start. The electronic control 40 thus first initiates the laundry arrangement sequence 59, in which the basket 10 is rotated at a speed that causes the centrifugal force experienced by the objects to be washed inside the basket 10 to be greater than the force of gravity, which causes the objects to be washed to stick to the cylindrical wall of the basket 10; immediately afterwards, the electronic control 40 starts the sequence for checking the water level which considers the signal obtained from the pressure switch 41, which indicates the water level inside the tub 11 according to the water level detected by the pressure switch 41, thus the electronic control determines whether or not it is necessary to admit water into the tub 11; in case the admission of water to the tub 11 is required, the electronic control 40 orders energizing at least one of the filling valves 45, until the pressure switch 41 detects the desired water level inside the tub 11; at this point the desired level is the minimum level or sensing level, the electronic control 40 therefore, if it has detected that the water level inside of the tub 11 is less than the minimum level or even that there is no water inside the tub 11, at least one of the filling valves 45 or both valves is energized depending on the desired temperature level (hot water valve 45 or cold water valve 45); immediately afterwards the electronic control 40 initiates the load detection or sensing sequence 60 which estimates the amount by weight of the objects to be washed inside the basket 10, thereby determining the level of water required for the progressive agitation sequences 62, arrangement 63, dehydration 64 and rinse 65 sequences; once the load has been estimated (amount by weight of the objects to be washed inside the basket 10), the electronic control 40 saves in memory the estimated textile load data as well as the water level associated with said textile load, then the electronic control 40 energizes at least one of the water intake valves 45 until the water level determined by the electronic control 40 is reached; in an alternative embodiment, the filling of water to a certain level is done by opening at least one or both water intake valves 45 according to the temperature selected by the user; in any case, during the filling of water, the objects to be washed are gently agitated inside the basket 11 with a washing pattern of short paddle strokes with low spm (e.g., an arc of 200° to 270°, with an spm of 20 to 40); once the certain level of water has been reached, the electronic control 40 interrupts the energization of at least one water intake valve 45 in addition to also interrupting the gentle agitation pattern that was used during the filling of water inside the tub 11; immediately afterwards, the electronic control 40 starts the progressive washing sequence 67 by agitating the objects to be washed contained within the basket 10, thus promoting the washing of the objects arranged inside the basket 10, the aforementioned progressive washing sequence 67 is carried out during a certain time that ranges from 1 minute to 50 minutes, depending on the type of laundry to be washed, the load, the agitation pattern to be used, the number of washing blocks to be used, the washing cycle to be used, among other factors specific to the construction and geometry of the washing machine 20; once the progressive agitation sequence 67 has been carried out, the electronic control 40 starts the arrangement and balancing agitation sequence 61, which has the function of uniformly distributing the objects arranged in the basket 10, trying to avoid the clumping of objects in a small area of the basket 10, with a view to facilitating dehydration by spinning of the objects arranged in the basket 10; once the arrangement and balancing agitation sequence 63 has been carried out, the electronic control 40 starts the dehydration sequence 64, in which the objects to be washed arranged in the basket 10 are dehydrated by means of centrifugal force by rotating the basket 10 for such an effect; once the load of textiles is dehydrated, the electronic control 40 starts the rinse sequence 65 in any of its modalities (spray rinse sequence 66 or deep rinse sequence 67), wherein the objects to be washed are rinsed inside the basket 10 culminating in their subsequent dehydration by extracting the wash liquor from the tub 11 by means of the drain pump 35 and drain hose 16; once this is done, the washing method object of the present invention is completed.

Thus, having broadly described the invention in question, it is found with a high degree of inventive step, its industrial application being undeniable, also noting that a person skilled in the art can glimpse alternative embodiments that must be included in the scope and spirit of the following claims.

The invention claimed is:

1. An adaptive washing method implemented in a washing machine, wherein the washing machine includes a cabinet that supports a tub which houses a basket that rotates concentrically inside the tub, the basket being driven by a motor which is mechanically coupled to an agitator and said basket, a clutch that allows coupling and uncoupling between the basket and agitator, a user interface that allows the user to select water levels, type of laundry, washing intensity, rinse mode, and an electronic control that controls actuators by means of drivers, a level sensor and a rotor position sensor inside the motor, and a spray system, said electronic control further comprising a memory and a processor configured to carry out the method, wherein the method comprises:

a. laundry arrangement sequence, which evenly distributes the objects to be washed inside the basket;

b. checking, by the electronic control, the water level to determine the water level inside the tub by means of the level sensor that is in communication with the electronic control;

c. filling, by a valve, the tub to a minimum level, with the reading from step b. the electronic control determines the volume of water to be admitted in the tub in order to carry out step d;

d. load sensing sequence, wherein the electronic control, by the rotor position sensor inside the motor, determines the amount of objects to be washed arranged in the basket (load) and the type of objects to be washed based on the resistance that said load offers to the movement of the agitator or propeller, wherein the load sensing sequence is carried out with a minimum volume of water or without water on the tub;

e. sequence of filling the tub to washing level, wherein the water level inside the tub required for step f. is determined according to the user preference of the water level to be used selected in the user interface, as well as with the data of step d;

f. progressive agitation sequence, wherein according to the user preferences selected in the user interface regarding the level of water to be used, the type of laundry, and wash intensity, together with the data of the load level determined in step d. and based on a table of initial values as well as variance of the agitation patterns, a plurality of progressive agitation patterns are formed, by the electronic control, within an agitation block; wherein each of the plurality of progressive agitation patterns comprises a period of time during which the agitator or propeller is operated with a length of arc or paddle stroke in a clockwise and counterclockwise direction, with a paddle stroke frequency that is determined by strokes per minute (spm) that cause agitation on the objects to be washed inside the basket, wherein the period of time during which the agitator or propeller is operated varies incrementally or decrementally for each of the plurality of progressive agitation patterns, wherein a length of the arc or paddle stroke varies incrementally or decrementally for each of the plurality of agitation patterns, wherein the strokes per minute vary incrementally or decrementally for each of the plurality of agitation patterns;

g. arrangement and balancing agitation sequence, in which the objects to be washed are spread and distributed inside the basket, avoiding excessive imbalance when spinning the basket;

h. dehydration, wherein the basket is rotated to generate a centrifugal force greater than the force of gravity, which causes the dehydration of the objects to be washed inside the basket;

i. rinse, wherein the wash liquor residues are removed, hydrating the objects to be washed followed by dehydration.

2. The method of claim 1, further comprising:

g. a spray sequence which can be activated together with any of sequences (b) to (i).

3. The method of claim 1, wherein according to the user's selection in the user interface the rinse sequence h. comprises a deep rinse.

4. The method of claim 1, wherein according to the user's selection in the user interface the rinse sequence h. comprises a spray rinse.

5. The method of claim 4, wherein the spray system comprises a spray pump in fluid connection with a spray hose that conveys water to a spray deflector.

6. The method of claim 4, wherein the spray system comprises a directional valve with a first fluid connection to a drain pump, a second fluid connection to a spray hose that conveys water to a spray deflector, and a third fluid connection with a drain hose that transports the water outside of the washing machine; wherein said directional valve is controlled by the electronic control which orders the direction in which the fluid must be transported.

7. The method of claim 1, wherein the progressive agitation sequence comprises a method for an agitation pattern sequence comprising the following steps:

i. obtaining the user preferences selected in the user interface regarding the level of water to be used, the type of laundry and wash intensity, together with the load level data determined in step d. and the water level of the tub;

ii. producing an agitation pattern with the data obtained in step i. based on a table of initial values, also producing the number of patterns "n" to be used;

iii. based on the table of variance values, determining the variance of the arc length of the series of paddle strokes in a Δarc value;

iv. based on the table of variance values, determining the variance of the frequency or spm of the series of paddle strokes in a Δspm value;

v. based on the table of variance values, determining the variance of the certain period in which the series of paddle strokes is executed in a Δtime value;

vi. agitating the objects to be washed inside the basket according to agitation pattern "i", where "i" is the number of the current agitation pattern;

vii. producing an agitation pattern i+1 with the data obtained in iii., iv., v.;

viii. repeating steps iii. to vii. until the condition "i"="n" is met.

8. The method of claim 7, wherein the progressive agitation sequence further comprises the following steps:

ix. determining the number of agitation blocks "k" with the data obtained in i. according to the table of values obtained through laboratory tests;

x. determining the number of agitation patterns with the values obtained in i. for a block "j" according to the table of values obtained through laboratory tests, where "j" is the current block number;

xi. producing an agitation block j+1 with the data obtained in iii., iv., v., ix., x.

xii. repeating steps viii. to x. until the condition "j"="k" is met.

9. The method of claim 5, wherein the spray rinse comprises the following steps: allowing a certain volume of water to enter the tub, spraying water through the spray deflector onto the objects to be washed contained in the basket while the basket rotates at a constant speed.

10. The method of claim 5, wherein the spray rinse comprises the following steps: allowing a certain volume of water to enter the tub, spraying water through the spray deflector onto the objects to be washed contained in the basket while the basket rotates being energized by a string of pulses, resulting in a non-constant rotation speed.

11. The method of claim 6, wherein the spray rinse comprises the following steps: allowing a certain volume of water to enter the tub, spraying water through the spray deflector onto the objects to be washed contained in the basket while the basket rotates at a constant speed.

12. The method of claim 6, wherein the spray rinse comprises the following steps: allowing a certain volume of water to enter the tub, spraying water through the spray deflector onto the objects to be washed contained in the basket while the basket rotates being energized by a string of pulses, resulting in a non-constant rotation speed.

* * * * *